US006662612B1

(12) United States Patent
Arciniega et al.

(10) Patent No.: US 6,662,612 B1
(45) Date of Patent: Dec. 16, 2003

(54) METHOD AND APPARATUS FOR FILLET FORMATION UNDER THE HEAD OF A HEADED PIN TYPE FASTENER

(75) Inventors: Oviedo R. Arciniega, Perris, CA (US); Thomas C. Chang, Torrance, CA (US)

(73) Assignee: Huck International, Inc., Tucson, AZ (US)

( * ) Notice: Subject to any disclaimer, the term of this patent is extended or adjusted under 35 U.S.C. 154(b) by 32 days.

(21) Appl. No.: 10/161,352

(22) Filed: Jun. 3, 2002

(51) Int. Cl.[7] ..... B21D 15/00; B21H 3/02

(52) U.S. Cl. ..... 72/110; 470/8; 470/57; 470/66; 470/176; 470/180

(58) Field of Search ..... 470/8, 9, 10, 57, 470/58, 66, 70, 71, 176, 180; 72/107, 110, 80, 103, 120, 121

(56) References Cited

U.S. PATENT DOCUMENTS

| | | | | |
|---|---|---|---|---|
| 3,758,900 A | * | 9/1973 | Morton | 470/68 |
| 4,326,825 A | | 4/1982 | Volkmann et al. | |
| 4,472,096 A | | 9/1984 | Ruhl et al. | |
| 4,667,971 A | | 5/1987 | Norton et al. | |
| 4,735,537 A | | 4/1988 | Rath | |
| 4,867,625 A | | 9/1989 | Dixon | |
| 5,090,852 A | | 2/1992 | Dixon | |
| 5,330,205 A | | 7/1994 | Norton | |
| 5,810,670 A | * | 9/1998 | Yamamuro et al. | 470/12 |
| 5,906,537 A | * | 5/1999 | Elcock et al. | 451/194 |
| 6,004,215 A | * | 12/1999 | Morath et al. | 470/164 |
| 6,017,275 A | * | 1/2000 | Webster et al. | 470/164 |
| 6,077,012 A | | 6/2000 | Granese et al. | |
| 6,095,733 A | | 8/2000 | Busby et al. | |
| 6,149,363 A | | 11/2000 | March | |

OTHER PUBLICATIONS

Pg. 5 from catalog showing BUCK AJUST–TRU© CHUCK.

* cited by examiner

*Primary Examiner*—Ed Tolan
(74) *Attorney, Agent, or Firm*—Harness, Dickey & Pierce, P.L.C.

(57) ABSTRACT

The present invention relates to apparatus and process for roll forming a fillet at the juncture of the shank and head of a pin type fastener. The process and apparatus can be preset to perform the fillet rolling at selected parameters and to monitor the parameters for providing parts with uniformly rolled fillets.

47 Claims, 16 Drawing Sheets

METHOD AND APPARATUS FOR FILLET FORMATION UNDER THE HEAD OF A HEADED PIN TYPE FASTENER

FIELD OF THE INVENTION

The present invention relates to a method and apparatus for fillet formation under the head of a metal pin type fastener.

BACKGROUND OF THE INVENTION

Metal fasteners of a pin type such as bolts, pins, rivets and the like are routinely formed with an elongated shank and an enlarged head at one end. In order to reduce any stress concentration at the juncture of the shank and head, a fillet radius is formed at that connection. With fasteners that are used to secure workpieces with a high clamp force the tensile load between the head and the shank can be significant. Thus it is desirable that the fillet radius at that juncture be well formed and of sufficient strength. It is common for a pin blank to be first formed by a cold or hot heading operation whereby the head is formed at one end of the shank. In the heading process a fillet radius is routinely formed at the juncture between the shank and the enlarged head. In addition it is not uncommon to perform a subsequent grinding step in which the fillet is also ground. Such fillets, however, when formed by heading and/or grinding may have certain inconsistencies in geometry, hardness and grain structure. It is also common to heat treat the pin blank to substantially remove variations in hardness and grain structure. It has also been common to attempt to remove geometric inconsistencies and increase fillet hardness by a subsequent rolling operation. In this regard, the hardness of the fillet is increased by cold working in rolling.

However, even here, with conventional rolling apparatus, there can be inconsistencies in the rolling process caused by variations in force or pressure, rolling speed and time or number of revolutions, shank diameters, head geometry, etc. In this regard variations in shank diameters, head geometry, etc. where the wrong blanks are fed for rolling may not be recognized. At the same time, such apparatus for rolling is not particularly versatile and can require substantial time for set up, modification for different diameters, different head styles, i.e. flush type or protruding type, blanks of different materials, etc. In addition the metallic pins are conventionally made of alloys of titanium, steel, aluminum and the like which can require different parameters for fillet rolling.

In this regard, it should be noted that with current, conventional rolling apparatus it is common to have the rollers oriented in a vertical plane with the input opening for receiving the pin blank to be rolled extending along a horizontal axis. Here the pin blank to be rolled may be fed down a slide and inserted horizontally into the input opening. It is also common to have the rollers oriented in a horizontal plane. Here the pin blank may be fed down a slide to a feed arm which will grip the pin blank and then move to a position to insert the pin blank vertically into the input opening. It is also common for the roller subassemblies to be moved radially in translation to enlarge the opening to facilitate insertion of the pin blank by the feed arm and then to close the opening for rolling.

SUMMARY OF THE INVENTION

As will be seen one of the unique features of the present invention locates the rollers in a horizontal plane with the input opening extending along a vertical axis. Here, however, the pin blank to be rolled is dropped vertically down a slide into the input opening with the natural assistance of gravity and without the need for a feed arm.

In addition, the structure for handling the pin blank for insertion for rolling and ejection after rolling is highly efficient whereby the overall cycle time for processing the pin blanks for rolling is reduced. In this regard the amount of rolling time can be increased while still resulting in a reduction in the overall cycle time. The increased rolling time can assist in providing more consistently rolled fillets.

Thus the present invention provides a unique method and apparatus for addressing the above problems while at the same time providing a relatively simple, quick means for the accurate set up and adjustment of the fillet rolling apparatus for operation. In addition the unique method and apparatus monitors various parameters of the process to provide a consistent, uniformly formed fillet radius on a preselected form of pin blank. At the same time, blanks rolled with the wrong parameters will be detected and rejected. This also results in the form of the pin blank being indirectly monitored to reject blanks of the incorrect form which will not attain the noted parameters in fillet rolling.

Another feature of the present invention is that various ones of the combination of elements of the rolling apparatus are of known structures but which have been readily modified or adapted to provide the unique combination of the present invention.

Thus it is an object of the present invention to provide a unique rolling method and apparatus for fillet formation at the juncture of the shank and head of pins, bolts and the like.

It is another object to provide such a unique rolling method and apparatus which facilitates adjustment to accommodate for differences in sizes, shapes, the fillet radius, materials, etc. of the pins, bolts and the like.

It is still another object to provide a unique rolling method and apparatus whereby the overall processing time per pin blank is minimized.

It is also an object of the present invention to provide a unique rolling method and apparatus in which the rollers are oriented horizontally with the input opening for receiving the pin to be rolled extending along a vertical axis whereby the pin to be rolled is inserted vertically by gravity.

It is still another object of the present invention to provide a unique method and apparatus for fillet rolling which monitors the significant factors involved in rolling such as applied load or force on the pin, bolt and the like during rolling, the size of the pin shank, type of pin head, the proper or improper application of steps in rolling and the like.

Thus the present invention provides a unique rolling apparatus and method for forming and working of the fillet radius at the juncture of the shank and enlarged head of pins, bolts, rivets and the like. The rolling apparatus and method facilitates set up and adjustment while monitoring various factors relating to the consistency and quality of the rolled fillets.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT(S)

The following description of the preferred embodiment(s) is merely exemplary in nature and is in no way intended to limit the invention, its application, or uses.

Figure 1:
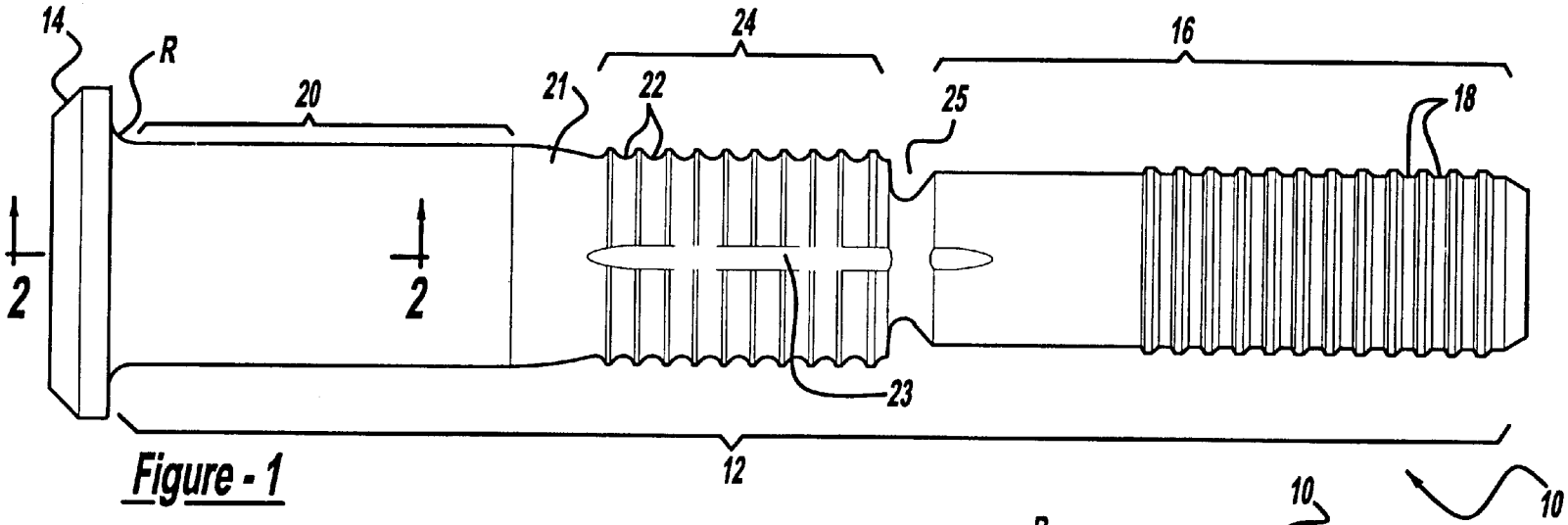
FIG. 1 is an elevational view of one form of a headed pin type fastener for a swage type fastener and as finally formed with the fillet radius rolled.

Looking now to the drawings, FIG. 1 depicts a pin 10 for one form of fastener. Here the pin 10 is for a pull type swage fastener. Swage fasteners with pins of such type are shown in U.S. Pat. No. 4,472,096 issued Sep. 18, 1984 for Optimized Fastener Construction And System and U.S. Pat. No. 6,077,012 issued Jun. 20, 2000 for Self-Retaining Fastener. It should be understood that the present invention can also be utilized for threaded fasteners such as shown in U.S. Pat. No. 4,326,825 issued Apr. 27, 1982 for Balanced Pin For Shear Flow Joint And Joint Including The Pin; U.S. Pat. No. 4,735,537 issued Apr. 5, 1988 for Thread Rolling And Fastener, and U.S. Pat. No. 6,149,363 issued Nov. 21, 2000 for Lightweight Threaded Fastener And Thread Rolling Die. Thus the term "pin", while described below for a swage type fastener, should be understood to include the various other forms such as threaded bolts, rivets and the like.

In the specific form shown the pin 10, which is of a swage type fastener, includes an elongated shank 12 with an enlarged, protruding type head 14 at one end. As is conventional with swage type fasteners of the pull type, the pin shank 12 terminates at the opposite end from the head 14 in a pull portion 16 having a plurality of annular pull grooves 18 adapted to be gripped by jaws of an installation tool. The installation tool can be of a construction well known in the art and since it does not constitute a part of the present invention it has been omitted for purposes of brevity and simplicity.

The pin shank 12 has a smooth shank portion 20 extending axially from the pin head 14 and is adapted to be located in bores in workpieces to be secured together. A plurality of annular lock grooves 22 are formed in a lock portion 24 of the pin shank 12 which extends axially from the smooth shank portion 20 via a smooth, tapered transition portion 21. The lock grooves 22 are adapted to receive the material of a collar type member as it is swaged during installation. For applications providing sealed joints utilizing a sealant a longitudinal slot 23 is located in the lock grooves 22 to provide a means for evacuating sealant from the pin 10 when the collar is swaged into the lock grooves 22 and to thereby facilitate the flow of collar material in swage. A breakneck groove 25 is located between the lock portion 24 and pull portion 16 and is adapted to fracture at a preselected relative axial force after completion of swaging of the collar into the lock grooves 22. Also while the pin 10 as shown is for a pull type swage fastener with the shank 12 having a pull portion 16 with pull grooves 18, the process and apparatus can be used for stump type swage fasteners such as shown in the '096 Patent noted above, where the pins do not have a pull portion.

As can be seen the pin head 14 is of the protruding head type and adapted to be located on the outer surface adjacent a bore in one of the workpieces being secured. A fillet radius R smoothly connects the pin head 14 to the smooth pin shank portion 20. It should be understood that the present invention is equally applicable to pins with a flush type head which have a tapered surface adapted to fit within a tapered countersunk bore portion in the workpiece bore.

Figure 2A:
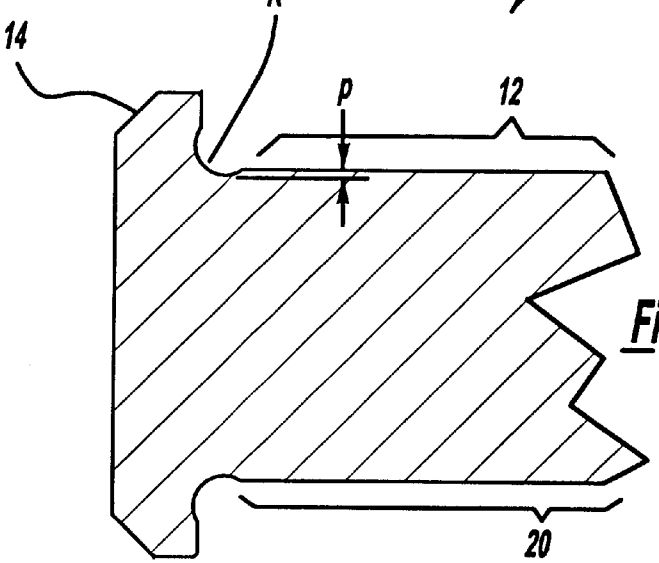
FIG. 2*a* is a fragmentary, enlarged view similar to FIG. 2 depicting the head of the pin after fillet rolling and as in the completed form of FIG. 1.
Figure 2:
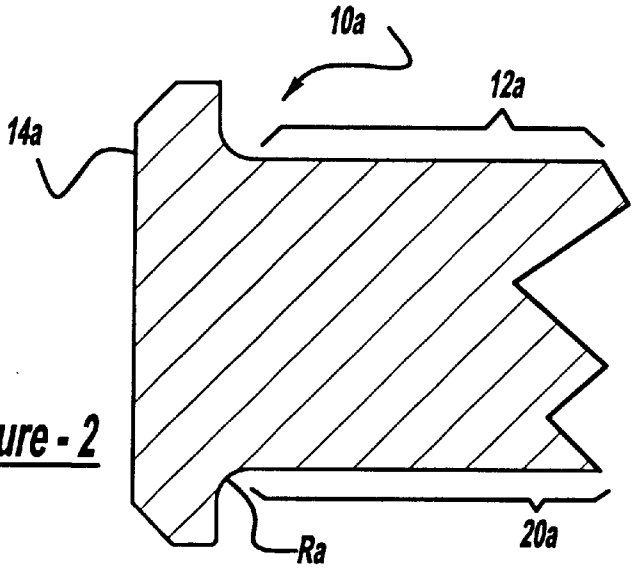
FIG. 2 is a fragmentary, enlarged sectional view of a portion of the pin of FIG. 1 taken generally in the direction of the Arrows 2—2 and depicting the head of a pin blank and a segment of the pin shank prior to fillet rolling.

The fillet radius R as shown in FIG. 1 is as finally formed after the rolling process to be described. FIG. 2, however, is a fragmentary enlarged view showing a portion of the pin as a pin blank 10*a* formed after the initial cold or warm heading but before the fillet rolling step with a fillet radius Ra. FIG. 2*a* is a view similar to FIG. 2 which is also enlarged to better depict the finally formed fillet radius R of the finished pin 10 of FIG. 1. Thus in the description of the portion of the pin blank 10*a* in FIG. 2, elements similar to like elements of the pin 10 in FIGS. 1 and 2*a* have been given the same numerical designation with the addition of the postscript "a". In this regard, the pin blank 10*a*, prior to rolling, can be subject to heat treat, as noted, with some grinding in selected areas including the fillet area. Also it is common for the pin blank 10*a* to have the pull grooves 18 rolled but with the rest of the pin shank 12 being smooth.

Thus the pin blank 10*a* includes a shank 12*a* and protruding head 14*a*. The head 14*a* is connected to a smooth shank portion 20*a* by a fillet radius Ra. The fillet radius Ra as initially formed by cold or warm heading and/or grinding will generally be of the same geometry as the fillet radius R finally formed after rolling; however, in numerous instances the finally formed fillet radius R will be slightly smaller or larger and of a slightly different geometry than the radius Ra. For example where a pin 10 is made of a titanium alloy and being generally of a ⅜ inch diameter it will have its fillet radius R of 0.022 inches which is less than the prerolled radius Ra of 0.024 inches. For these sized fasteners, it is typical to roll the fillet radius R to be 0.002 to 0.003 inches less than the pre-rolled radius Ra with a modification P in the final geometry not greater than around 0.0003 inches. The modification which is the radially inner protrusion P of the rolled radius R is exaggerated in FIG. 2*a*. Prior fillet rolling processes and equipment also result in similar modifications in the final geometry of the rolled fillet from the pre-rolled fillet. However, as noted, and as will be described, in any event, the fillet rolling process of the present invention substantially eliminates geometric inconsistencies between rolled pin blanks, forms a smooth contour with controlled, limited variation and provides a desired amount of work hardening for the fillet radius R. Such consistency of a uniform fillet radius is provided with pin blanks in one batch and from batch to batch of pin blanks. But, as also previously noted and as will be further described, prior rolling processes and apparatus could provide pins of the same kind with rolled fillets of inconsistent geometry and with the apparatus requiring substantially more time for set up and adjustments, modifications for various pins and, with limited means for monitoring and controlling the processing for uniformity. In addition, the present invention also minimizes the overall time for processing each pin blank.

Figure 3:
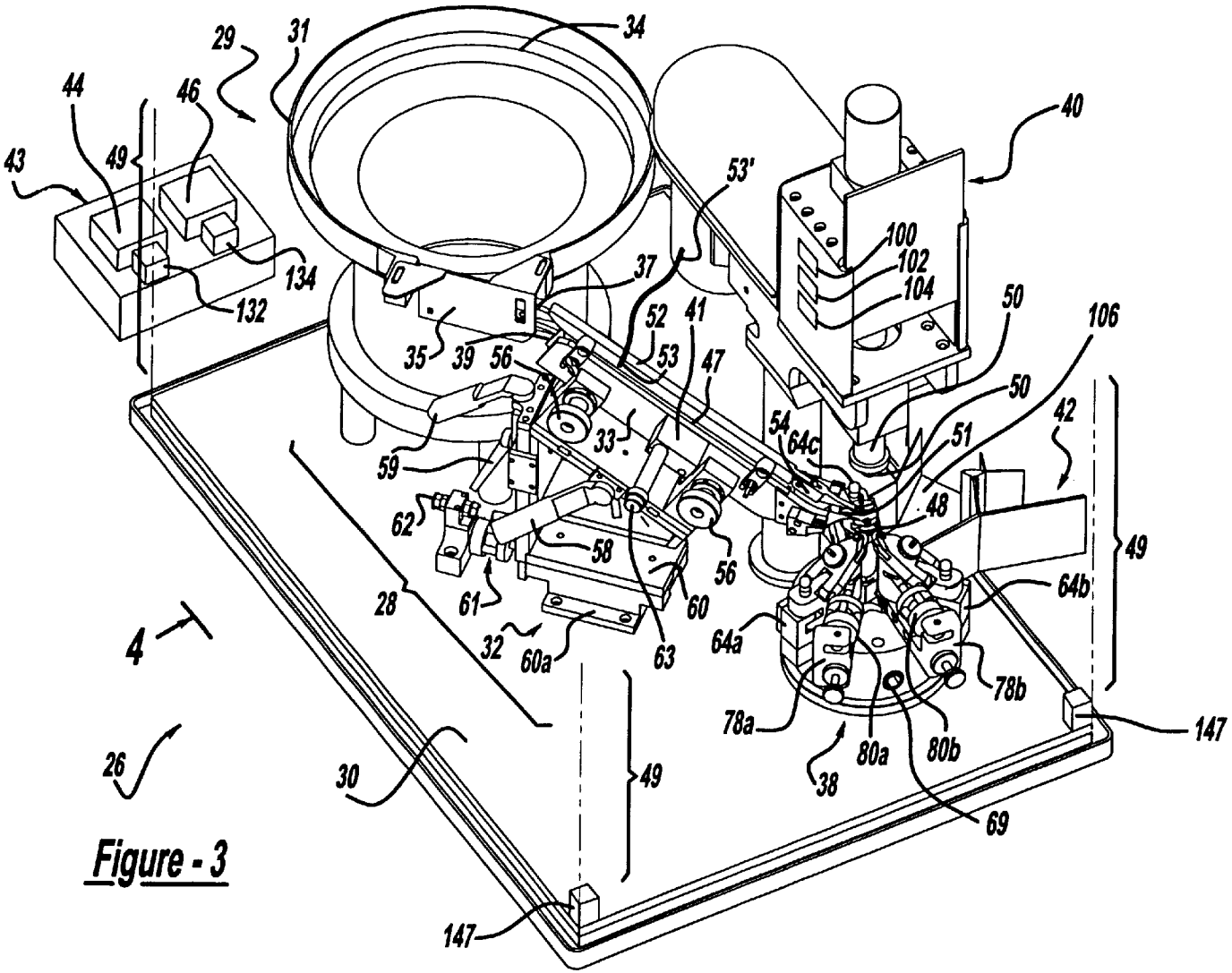
FIG. 3 is a perspective view of the fillet rolling apparatus of the present invention including a hopper supply bowl assembly, a feeder slide assembly, a roller assembly, a rotary push rod assembly, a discharge slide, and a control and logic board including a central processing unit and a speed and timing assembly with a cam subassembly.
Figure 4:
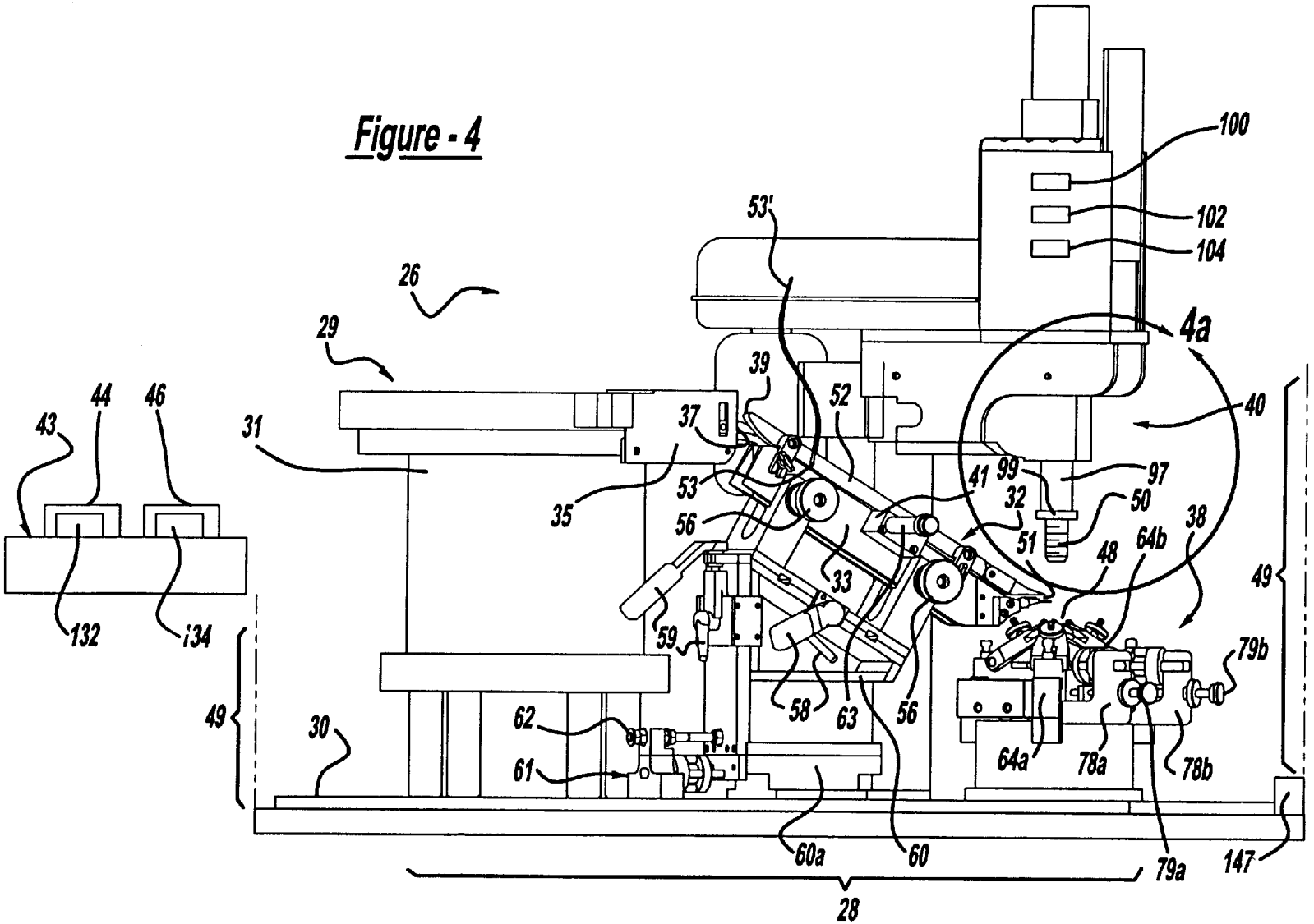
FIG. 4 is a side elevational view of the fillet rolling apparatus of FIG. 3 taken generally in the direction of the Arrow 4 in FIG. 3.

Looking now to FIGS. 3 and 4, the fillet rolling apparatus 26 of the present invention is shown with the mechanical structure 28 mounted on a support platform or bed 30. As will be seen the mechanical structure 28 can include certain elements that are of a generally conventional construction but are in a unique combination with some modifications.

The mechanical structure 28 of the apparatus 26 includes a hopper or feeder bowl assembly 29, a slide assembly 32, a roller assembly 38, a rotary push rod assembly 40 and a discharge slide 42. The feeder bowl assembly 29 includes a hopper bowl 31 and pin feeder 35 while the slide assembly 32 includes a feeder slide 33 and a controlled collector and feed gate 41. The apparatus 26 also includes a control and logic board 43 which assists in monitoring and controlling various operative functions to be described. The control and logic board 43 is separated from the mechanical structure 28 and the support platform 30. In this regard, the mechanical structure 28 of the apparatus 26 is surrounded by sliding or pivotal doors or windows 49 whereby the mechanical structure 28 can be observed and accessed by the operator by opening the doors or windows 49 and for operation can be closed for safety purposes. Since such doors or windows are commonly used in the art, the specific details thereof have been omitted and for purposes of simplicity are only generally indicated with phantom lines in FIGS. 3 and 4.

As will be seen the control and logic board 43 has a central processing unit 46 (CPU 46) which receives a number of signals indicative of various conditions whereby certain operations of the fillet rolling apparatus 26 will be monitored and automatically controlled by the control and logic board 43.

The CPU 46 can be selectively programmed to respond to the signals indicative of the various operative functions being monitored to provide the necessary control signals to assure the desired operation of the mechanical structure 28 of the apparatus 26. In this regard the CPU 46 can be of a conventional form known in the art, such as Model No. Micrologix 1000 made by Allen-Bradley of Rockwell Automotive. Also the cycle speed of the apparatus 26 and timing and sequence of various elements can be selectably preset by the operator via a cycle speed and timing assembly 44 to be described.

Figure 5:
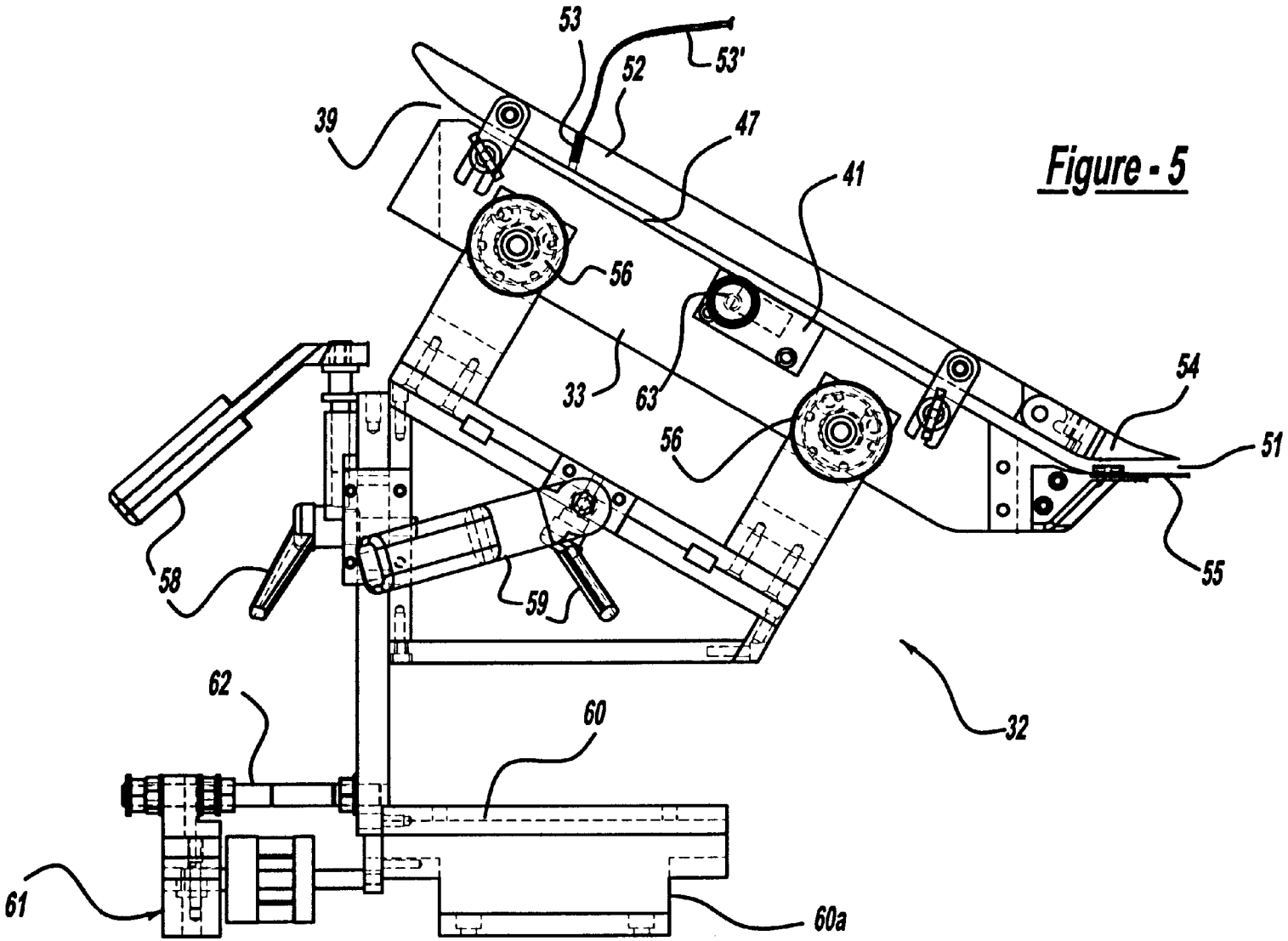
FIG. 5 is a side elevational view of the feeder slide assembly of the apparatus of FIGS. 3 and 4 for feeding pin blanks to be rolled to the roller assembly.
Figure 6:
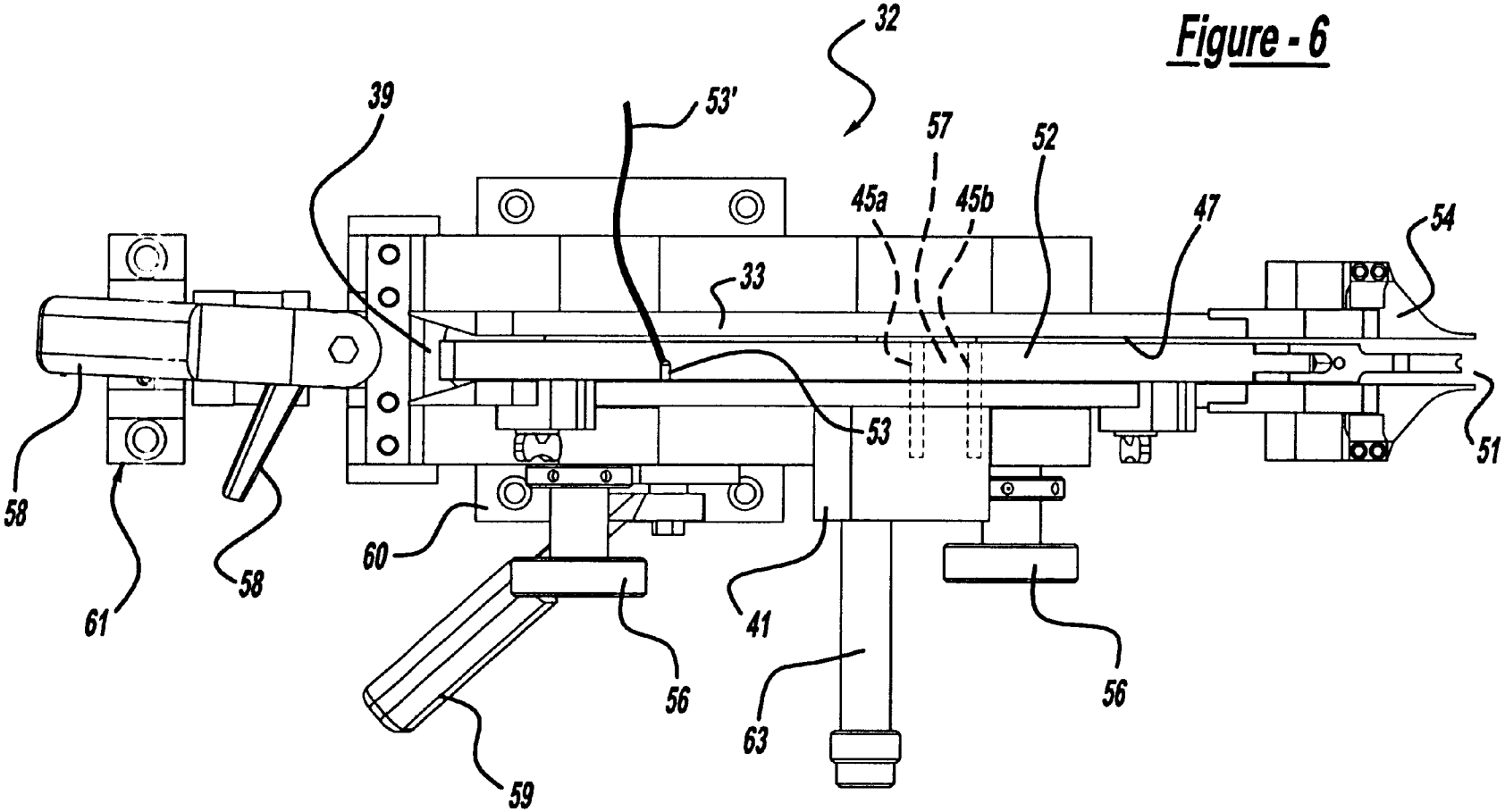
FIG. 6 is a top elevational view of the feeder slide assembly of FIG. 5.

In general the hopper bowl 31 is adapted to hold a large number of pin blanks 10*a* after the heading operation and to feed the pin blanks 10*a* from the pin feeder 35 to the feeder slide 33. The pin feeder 35 has an open outlet gate 37 through which pin blanks 10*a* are periodically fed to the inlet 39 of the feeder slide 33. See FIGS. 5 and 6. The feeder slide 33 is angulated downwardly from the outlet gate 37 of the pin feeder 35. Looking to FIGS. 3–6, the feeder slide 33 defines a slot 47 of preselected width such that the head 14*a* of the pin blank 10*a* will rest on the top with the shank 12*a* extending through the slot 47. In one form of the invention the feeder slide assembly 32 was generally of a known form supplied by MSC Industrial Supply Co. as CATALOG NO. 09862186. Upon receiving the pin blanks 10*a* at the inlet 39 the feeder slide 33 will permit the pin blanks 10*a* to slide downwardly by gravity to the controlled collector and feed gate 41. The controlled feed gate 41 is located midway down the feeder slide 33. A selected number of pin blanks 10*a* are collected at the collector and feed gate 41 which is periodically actuated to permit one pin blank 10*a* at a time to slide down the feeder slide 33 to its outlet end 51.

A sensor 53 is located in a slot in a roof plate 52 a preselected distance to the rear of the collector and feed gate 41. This will sense the presence of a pin blank 10*a* at that location and thereby indicate then that the feeder slide 33 is filled with pin blanks 10*a* of a preselected number down to the entrance of the collector and feed gate 41. When the number of stored pin blanks 10*a* falls below that number then the sensor 53 produces a signal via a line 53' to the hopper bowl 31 which will cause it to be actuated to move more pin blanks 10*a* through the outlet gate 37 to the collector and feed gate 41. When the number of pin blanks 10*a* again reaches the desired number, the sensor 53 will provide a signal to the hopper bowl 31 by which it will be deactuated.

In addition, the collector and feed gate 41 has an upper, entrance meter finger 45*a* and a lower, exit meter finger 45*b* at its outlet end. The meter fingers 45*a* and 45*b* are longitudinally spaced apart a distance to provide a holding area 57 for one pin blank 10*a* in between. The meter fingers 45*a* and 45*b* are normally biased to their closed positions blocking the feeder slide 33 and maintaining the pin holding area 57 closed. The meter fingers 45*a* and 45*b* and holding area 57 are only generally shown by dotted lines in FIG. 6. The meter fingers 45*a* and 45*b* are actuated in synchronism via an air actuated cylinder 63. Now when a pin blank 10*a* is to be released down the feeder slide 33 the lower, exit meter finger 45*b* is actuated to be moved out of a blocking position from the pin holding area 57 whereby the captured pin blank 10*a* can now slide down the feeder slide 33 to be dropped into a work, input opening 48 of the roller assembly 38. Next the lower meter finger 45*b* is actuated to again close the collector and feed gate 41. The upper, entrance meter finger 45*a* is then actuated to be moved out of blocking position whereby a pin blank 10*a* from the amount stored in the collector and feeder gate 41 can slide down into the pin holding area 57. Now the upper meter finger 45*a* is moved back to its closed position to close the pin holding area 57 with the one pin blank 10*a* inside. The actuation of the upper and lower meter fingers 45*a* and 45*b* by the air actuated cylinder 63 is controlled by a signal from the speed and timing assembly 44. Since the feeder slide assembly 32, the collector and feeder gate 41 and the above related apparatus are of forms well known in the art, as previously noted, the details have been omitted for purposes of brevity and simplicity.

The hopper or feeder bowl assembly 29 can be of a generally conventional, vibrator actuated hopper bowl construction well known in the art. As such the hopper, feed bowl 31 has a vibrationally actuated helically extending conveyor ramp 34 by which pin blanks 10*a* located in the hopper bowl 31 are moved circularly, helically up the ramp 34 to the open outlet gate 37 of the pin feeder 35. In one form of the invention the hopper and feeder bowl assembly 29 was of a known form manufactured by FMC Corporation as SNTRN Model No. 18512.

Now the pin blank 10*a* will slide down from the open outlet gate 37 to the pin storage area above the collector and feed gate 41. Unlike prior rolling apparatus and procedures to be noted, here the feeder slide assembly 32 is selectively, movable longitudinally, in translation on the platform 30 such as to move the outlet end 51 of the feeder slide 33 to a desired position for insertion of the pin blank 10*a* into the work, input opening 48 of the roller assembly 38 and to thereafter retract the slide assembly 32 and the outlet end 51 of the feeder slide 33 away from the opening 48 of the roller assembly 38. The outlet end 51 is not inclined as is the rest of the feeder slide 33 but rather extends generally horizontally and is positioned to facilitate vertical insertion by gravity of the pin blank 10*a*, in a manner to be described, into the work, input opening 48 of the roller assembly 38.

Figure 7:
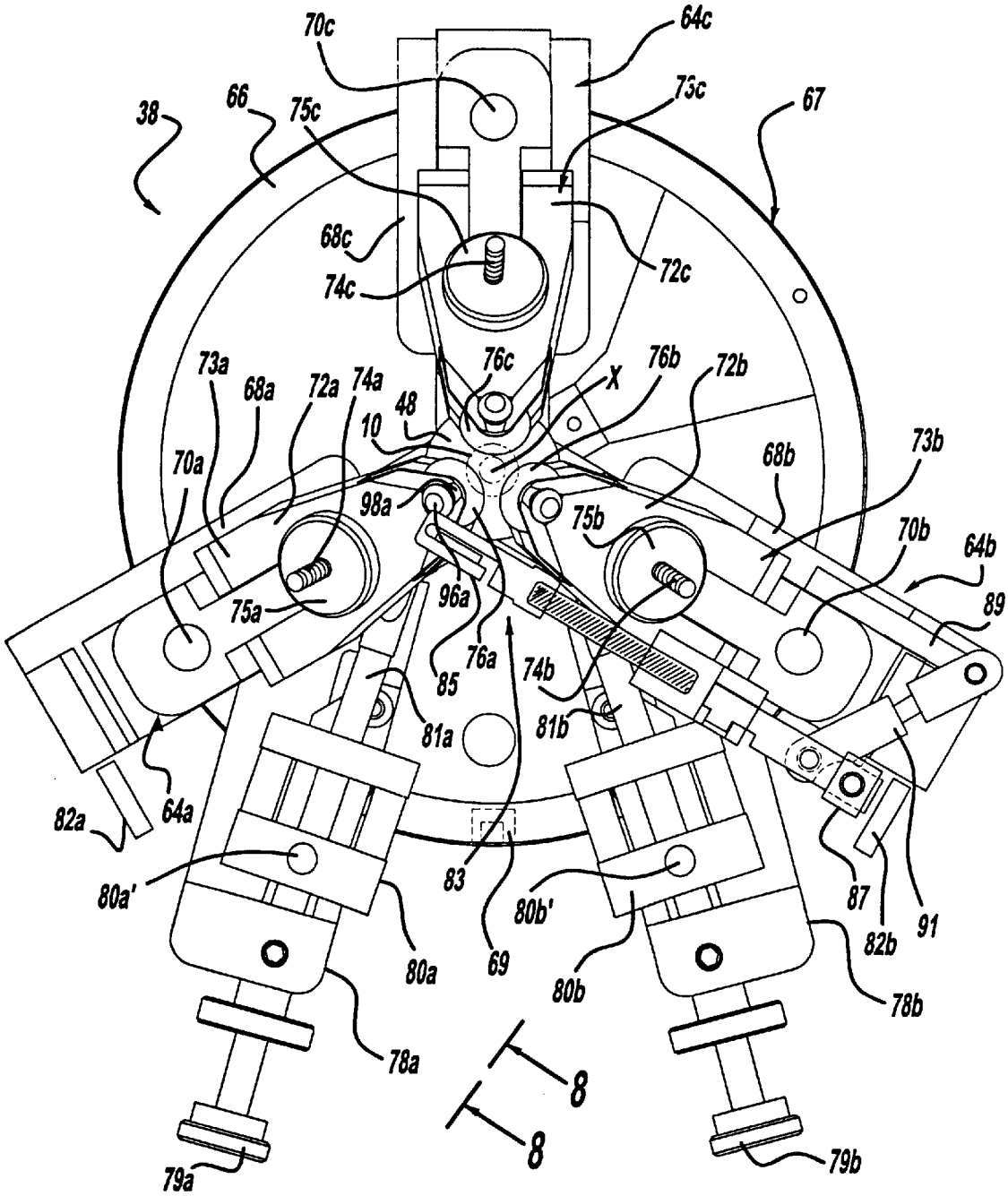
FIG. 7 is a top elevational view of the roller assembly of the fillet rolling apparatus of FIGS. 3 and 4 including three roller subassemblies shown assembled onto a chuck with the head of the pin blank shown in phantom lines in the position for rolling.
Figure 7A:
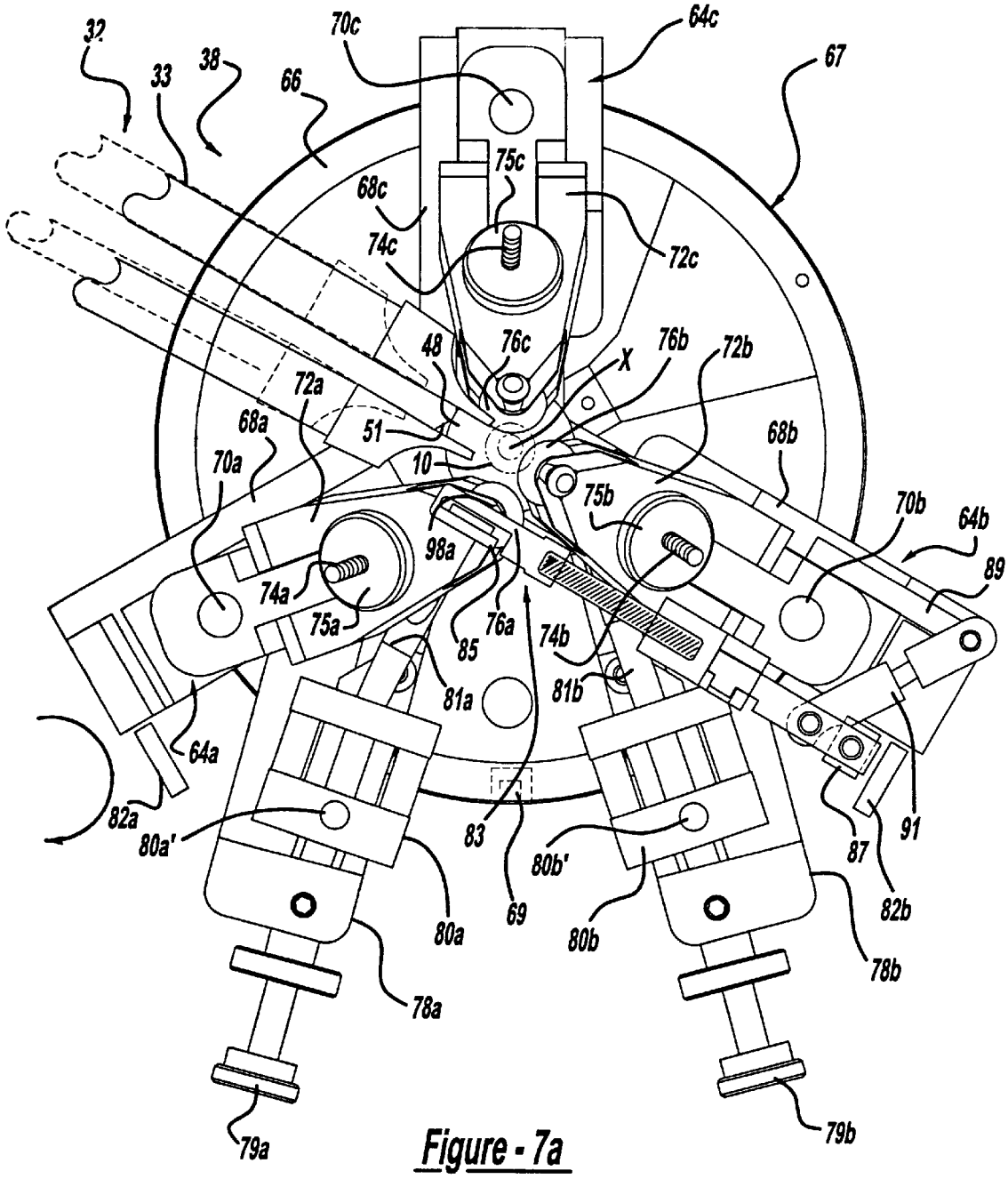
FIG. 7*a* is a view similar to FIG. 7 showing the condition of the roller subassemblies for receiving a pin blank to be rolled with the head of the pin shown as received shown in phantom lines.
Figure 7B:
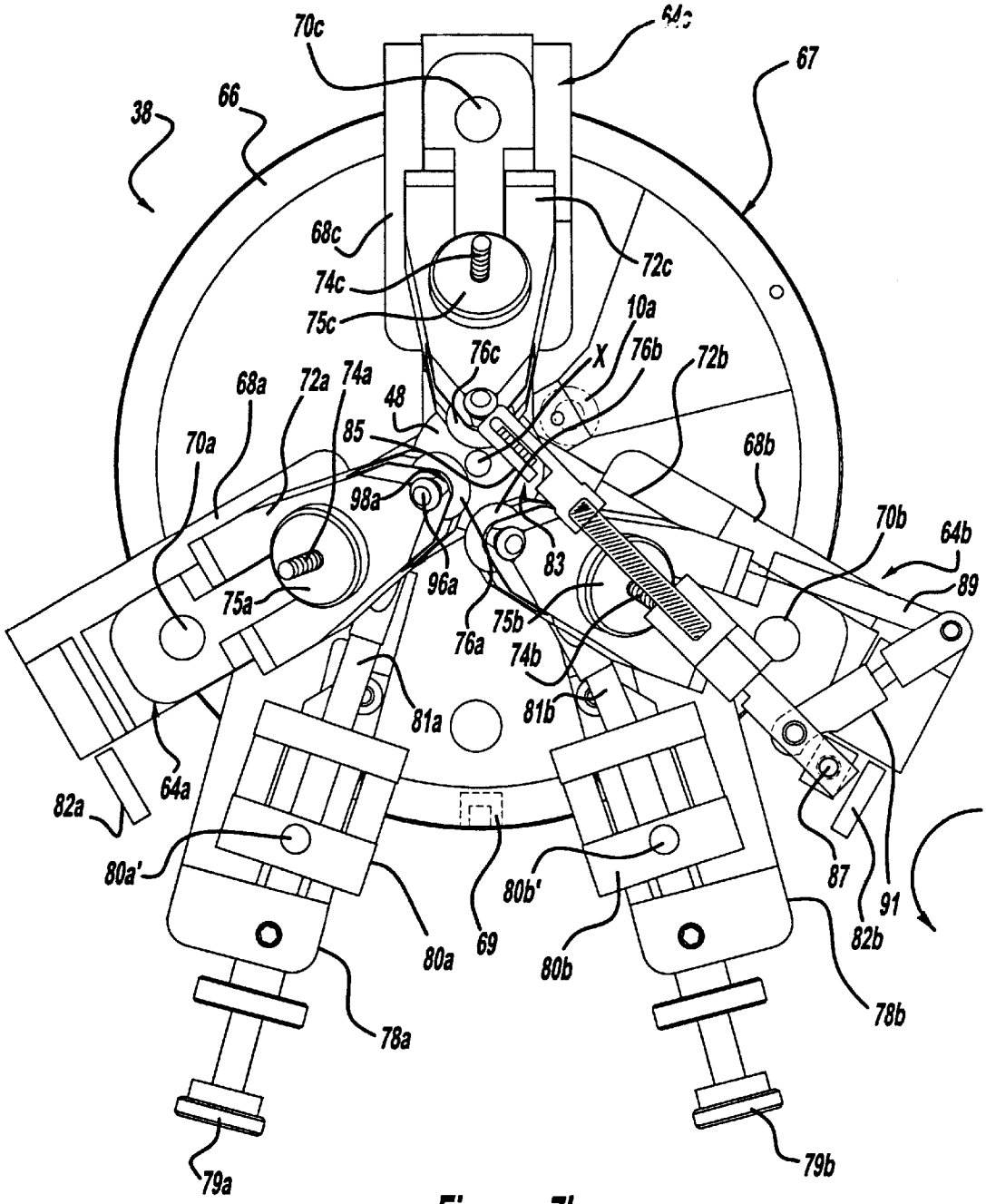
FIG. 7*b* is a view similar to FIG. 7 showing the condition of the roller subassemblies for discharging the pin blank after rolling with the head of the pin shown being discharged shown in phantom lines.

The work, input opening 48, which has a vertical axis X, is initially partially enlarged as shown in FIG. 7*a*, and in a manner to be described, to facilitate insertion of the pin blank 10*a*. After insertion, the work, input opening 48 is then returned to its operative size for rolling as shown in FIG. 7. Next the rotary push rod assembly 40 is actuated to move a rotatable push rod 50 downwardly into engagement with the pin head 14*a*. The push rod 50, which is in rotation, engages the pin head 14*a* under a preselected force and will rotate the pin blank 10*a* at a preselected speed within the input opening 48 against fillet rollers (to be described) which are in engagement with the fillet radius Ra under the pin head 14*a*. Here the rate of rotation of the push rod 50 and the engagement force is pre-set by the operator for that particular type of pin blank 10*a*. The surface of the push rod 50 which engages the pin head 14*a* is formed with a roughened surface, such as serrations to inhibit slippage between the engaged surface of the push rod 50 and the pin head 14*a*. Upon completion of the fillet rolling after a preselected time the push rod 50 is retracted upwardly and the roller assembly 38 is actuated to enlarge the input opening 48 in a different manner as shown in FIG. 7*b* whereby the pin blank 10*a*, with the fillet radius Ra now rolled to the fillet radius R, can be discharged into the discharge slide 42. Now the work, input opening 48 is again returned to its operative size as shown in FIG. 7 in preparation for the next rolling cycle.

As noted the feeder slide assembly 32 is of a generally known form. Looking now to the feeder slide assembly 32 as shown in FIGS. 3–6, the roof plate 52 is elongated and extends in a spaced relationship over the slot 47 of the feeder slide 33 to inhibit pin blanks 10*a* from inadvertently falling out. The spacing is preselected to permit the insertion of a pin blank 10*a* having the head 14*a* of a predetermined size but can block pin blanks with a larger head. The roof plate 52 terminates in a generally horizontally extending upper arm 54 which is located at the outlet end 51 of the feeder slide 33. A lower outlet arm 55 extends horizontally in generally spaced parallelism below the upper arm 54 at the outlet end 51 of the slide 33. As noted this orients the pin blank 10*a* vertically such that as it slides out it will be vertically oriented and thereby dropped vertically by gravity into the input opening 48 of the roller assembly 38. The width of the slot 47 can be readily adjusted for pin blanks 10*a* with pin shanks 12*a* of varying diameters by manipulation of adjustment screws 56. Thus pin blanks having a larger diameter shank than the pin blank 10*a* will be blocked from entering the feeder slide 33. In addition the angle and overall height of the feeder slide 33 can be adjusted via levers 59 for different assemblies. At the same time the lateral position of the feeder slide 33 can be adjusted via levers 58. In this regard such slide assemblies have been used with fastener pins and also could be adjusted to block pins with a larger head size and larger diameter shank. At the same time such known slide assemblies also have levers to adjust for angle, overall height and lateral position.

The feeder slide 33 is mounted on a support plate 60 which is slidably supported in a grooved structure on the top of a support block 60*a* which is fixed to the platform 30. The feeder slide 33 is selectively movable in translation by a pneumatic air piston assembly 61 acting on the support plate 60 between an advanced position with the outlet end 51 in line with the roller work input opening 48 for feeding a pin blank 10*a* and a position retracted from the roller input opening 48 after the pin blank 10*a* has been released into the opening 48. The reciprocation between the advanced and retracted positions is caused by alternately applying pressure and exhaust to opposite sides of the piston assembly 61. A proximity and position sensor 62 is supported relative to the platform 30 and is operatively connected to the feeder slide 33 to detect when it is in the advanced or retracted positions and to provide a signal as to such to the CPU 46 on the control and logic board 43. In addition the initial desired, aligned position of the feeder slide 33 relative to the outlet gate 37 and input opening 48 can be manually adjusted longitudinally such as by the arm of sensor 62. In one form of the invention the proximity sensor 62 was of a known structure made by ALLEN-BRADLEY 871C-DM1NN7-P3. Let us now look to the roller assembly 38.

The roller assembly 38 can best be seen in FIGS. 3, 4 and 7. The roller assembly 38 includes three roller subassemblies 64*a*, 64*b* and 64*c* mounted on a chuck body 66. The chuck body 66 is part of a universal type of chuck 67 which can be of a type manufactured by Buck Chuck Company and supplied by MSC Industrial Supply Co., under Catalog No. 08546061 and modified as noted below. Since such chucks are well known in the art the details thereof have been omitted for purposes of brevity and simplicity. In this regard it should be noted that such universal chucks are carriers for jaws for gripping workpieces to be machined such as on a lathe. In the present invention, such chuck has been adapted for use in selectively adjusting the position of the roller subassemblies 64*a–c* in unison to facilitate the setting of the desired working diameter DR of the roller input opening 48 for pin blanks of different geometry.

Each of the roller subassemblies 64*a–c* includes a roller section 73*a, b* and *c* secured to a mounting slide stand 68*a, b* and *c* by threaded fasteners 70*a, b* and *c*. While the roller section 73*c* is locked into a preselected fixed position on the slide stand 68*c* by the fastener 70*c*, the roller sections 73*a* and 73*b* are supported for pivotal movement horizontally on the slide stands 68*a* and 68*b* by fasteners 70*a* and 70*b* for a purpose to be seen.

Figure 8:
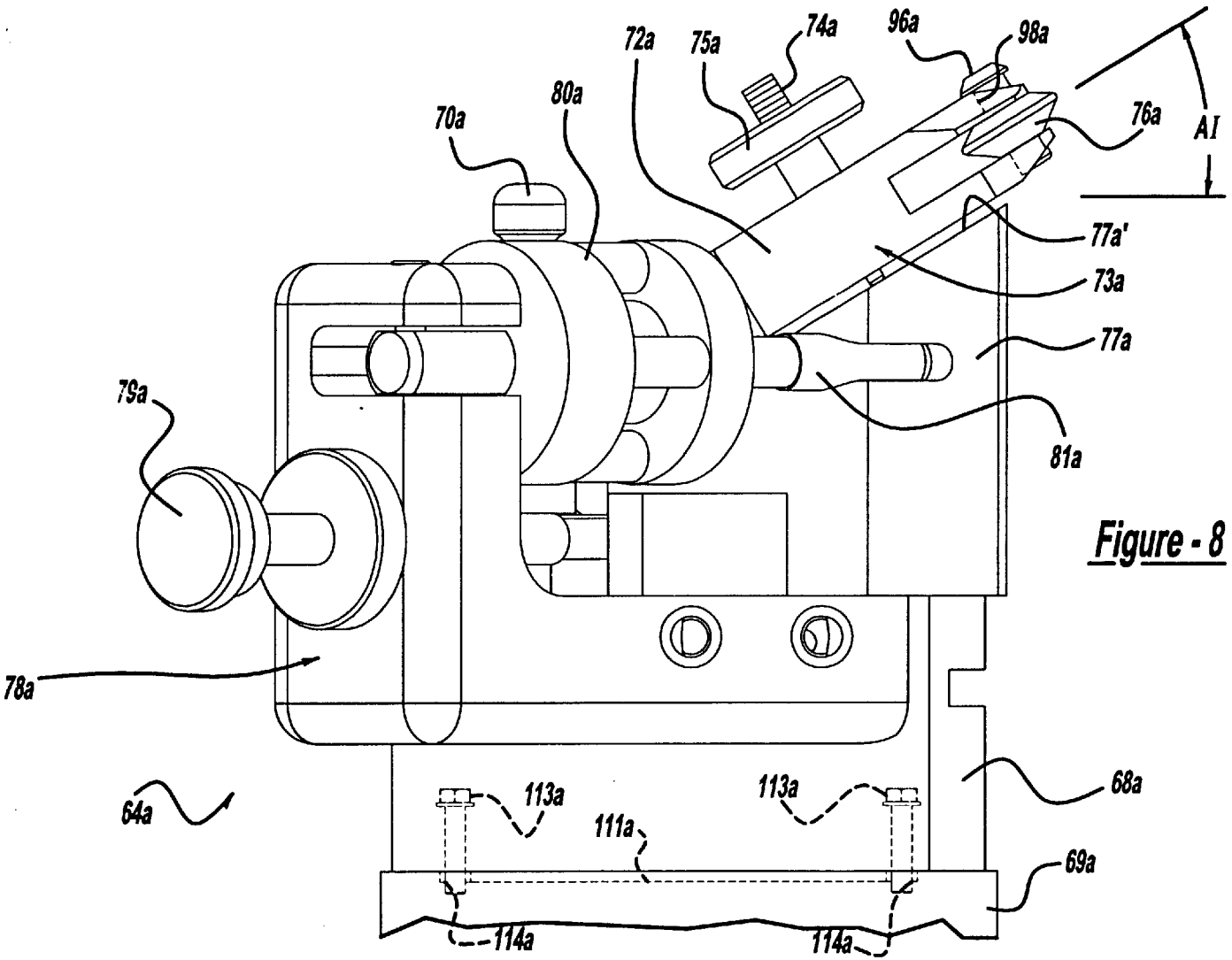
FIG. 8 is a perspective view of one of the roller subassemblies of the roller assembly of FIG. 7 taken in the direction of the Arrows 8 in FIG. 7.
Figure 8B:
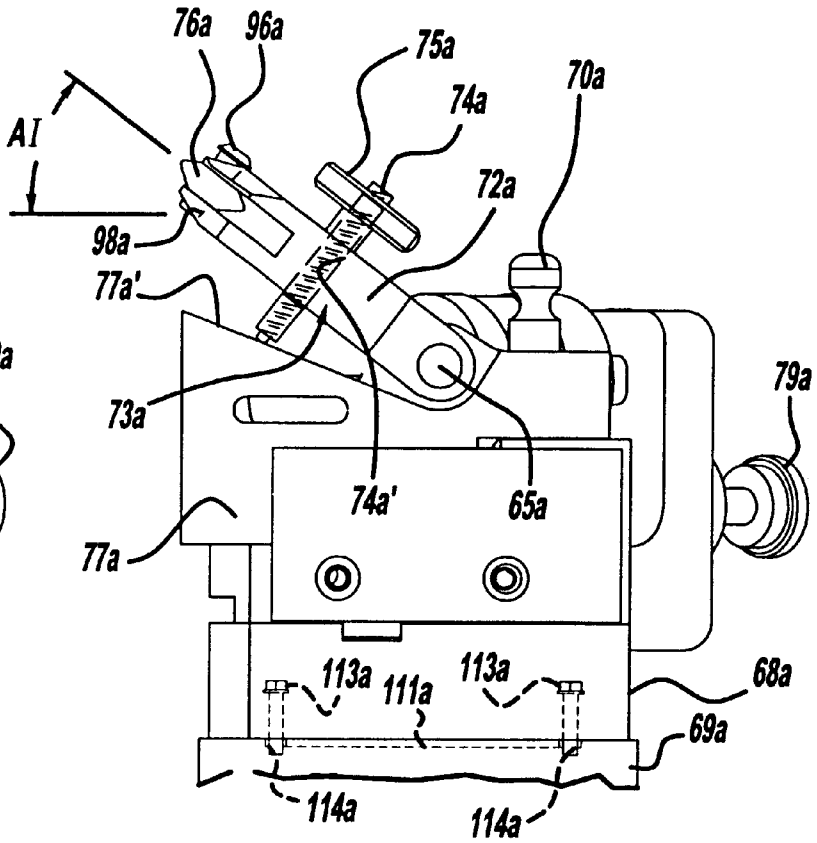
FIG. 8*b* is an elevational view similar to FIG. 8*a* depicting the roller angle adjustment section setting the roller at a different angle.
Figure 8A:
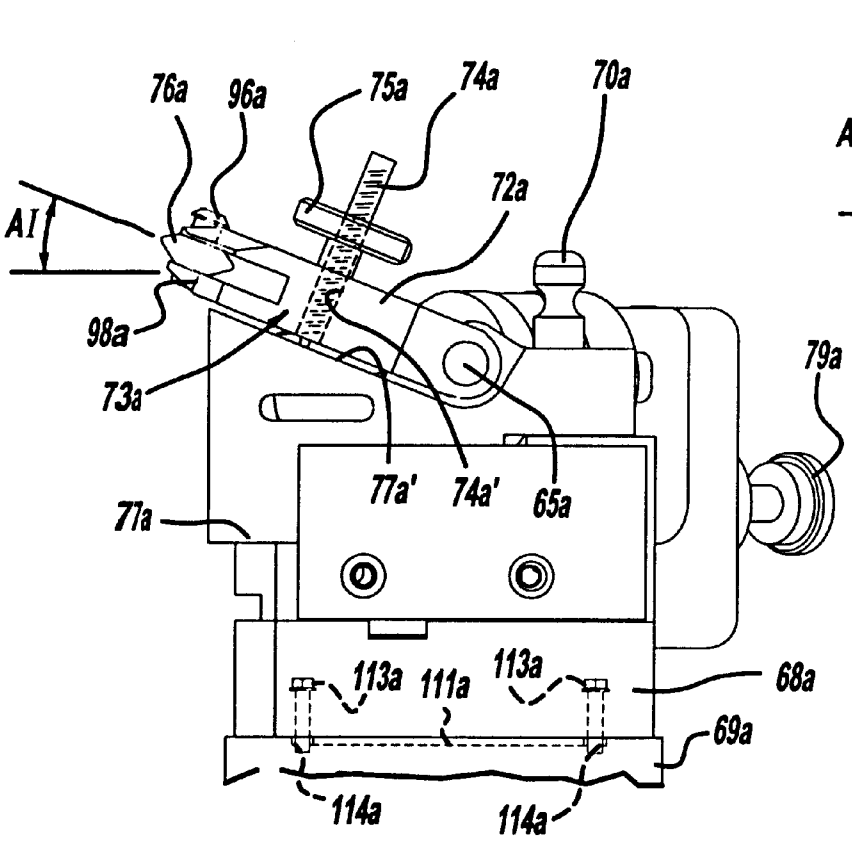
FIG. 8*a* is an elevational view of the roller subassembly of FIG. 8 taken from the opposite side and depicting the roller angle adjustment section setting the roller at one angle.
Figure 9:
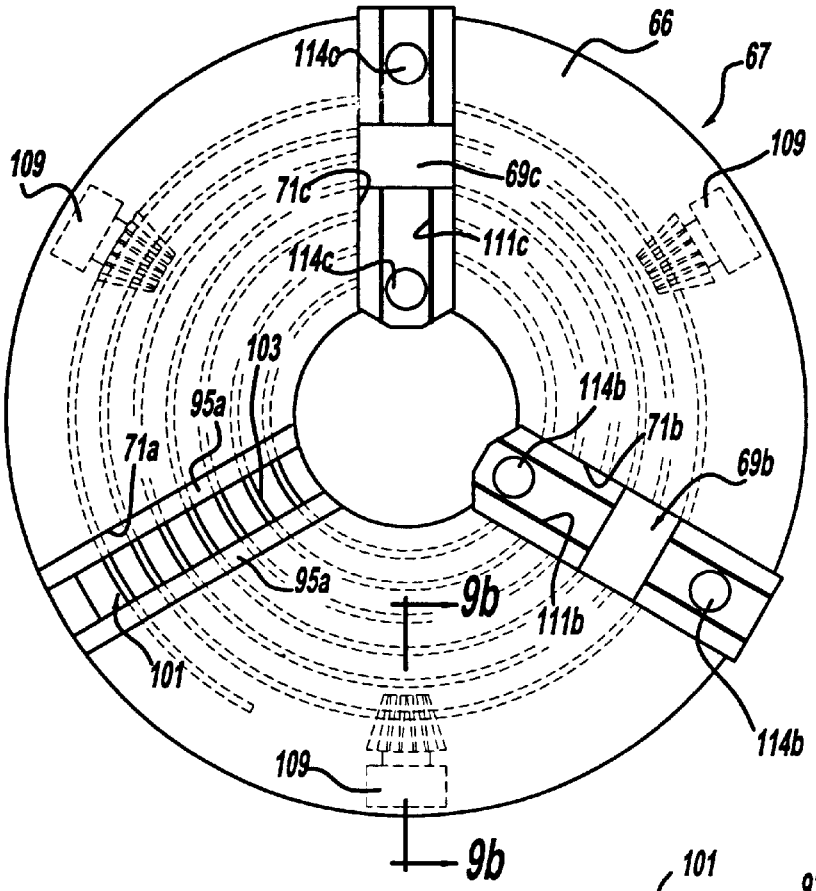
FIG. 9 is a top elevational view of the chuck of FIG. 7 with the roller subassemblies removed.

At the same time each of the roller subassemblies 64*a–c* has its mounting slide stand 68*a–c* secured to radially movable chuck slides 69*a–c*, such as chuck slide 69*a* partially shown in FIGS. 8, 8*a*, 8*b* and 9*a* and chuck slides 69*b* and *c* shown in FIG. 9.

Looking now to FIG. 9, the chuck body 66 of the chuck 67 has three circumferentially spaced, radially extending slots 71*a*, 71*b* and 71*c* adapted to receive and slidably support the slides 69*a*, 69*b* and 69*c*, respectively. As noted, the chuck slides 69*a–c* routinely have jaws secured thereto which can be simultaneously moved radially to grip workpieces of different diameters for machining.

Figure 9A:
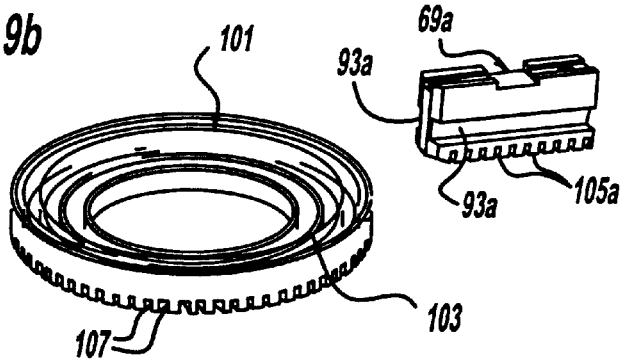
FIGS. 9*a* and 9*b* are an exploded pictorial view of the actuating scroll member and slide stand of the chuck.
Figure 9B:
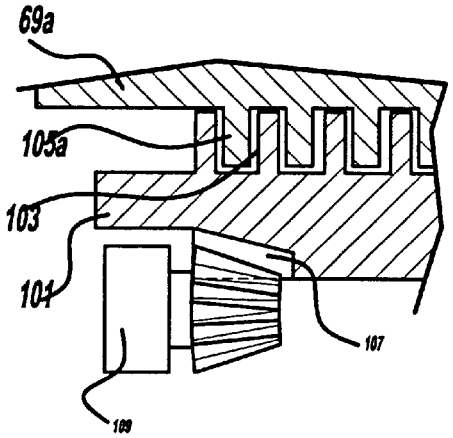

The slides 69*a–c* are provided with grooves such as grooves 93*a* as shown in FIG. 9*a*, which are slidably supported on ridges in the slots 71*a–c*, such as ridges 95*a* as shown in slot 71*a*. The ridges, such as ridges 95*a*, are located midway within the slots 71*a–c*. The slides 69*a–c* are provided with a pair of radially spaced threaded bores 114*a–c*, see FIGS. 8 and 9. The bores 114*a–c* are located within slots 111*a–c* which are below the upper surfaces of the slides 69*a–c*. In this way the slide stands 68*a–c* can be threadably secured to the slides 69*a–c* via bolts, such as bolts 113*a* in threaded bores 114*a*. See FIG. 8.

An actuating scroll member 101 is rotatably supported in the chuck body 66 and has a helically extending scroll structure 103 on its upper surface. The scroll structure 103 is adapted to be drivingly engaged with a plurality of helically extending grooves on the lower surface of the slides 69*a–c* such as grooves 105*a* on slide 69*a*. The actuating scroll member 101 has a plurality of circumferentially spaced, radially extending gear teeth 107 on its lower surface. Three circumferentially, equally spaced radially extending pinion gears 109 are rotatably supported in the chuck body 66 in radially fixed positions in engagement with the gear teeth 107. The pinion gears 109 can be selectively manually actuated by a conventional tool such as a hex head wrench.

Now the specific desired diameter DR of the opening 48 can be selectively set by actuation of any one of the adjustment pinion gears 109 which is actuable to simultaneously radially move the slides 69*a–c* whereby the roller subassemblies 64*a–c* can be moved radially towards and away from the axis X in unison. This simple, single adjustment mechanism facilitates set up of the roller subassemblies 64*a–c* of the roller assembly 38 to accommodate fillet rolling, for pin blanks 10*a* of different diameters and geometries. In order to initially position each of the chuck slides 69*a–c* and thus each of the roller subassemblies 64*a–c*, radially equally from the axis X of the input opening 48 the slots 71*a, b* and *c* are spaced circumferentially slightly different distances from each other with the grooves 105*a* selected to accommodate the pitch of the drive scroll structure 103.

The roller sections 73*a, b* and *c* include roller platforms, such as roller platform 77*a* best seen in FIGS. 8, 8*a* and 8*b*. Fillet rollers 76*a, b* and *c* are rotatably supported in slots 98*a, b* and *c* at the outer end of the roller supports 72*a, b* and *c* to define the roller input opening 48. The roller supports 72*a–c* are pivotably, vertically secured to the platforms such as platform 77*a* via a pivot pin, such as pivot pin 65*a* shown in FIGS. 8*a* and 8*b* for vertical inclination. Thus the angle of inclination AI of the roller supports 72*a–c* and fillet rollers 76*a–c* can be selectively adjusted via adjustment bolts 74*a, b* and *c* which are threadably engaged with threaded bores such as bore 74*a*' extending through the roller support 72*a*. The bolts 74*a, b* and *c* extend through the roller supports 72*a, b* and *c* with the lower end of the bolts 74*a, b* and *c* engaging an inclined upper surface, such as surface 77*a*' on the roller platform 77*a* shown in FIGS. 8, 8*a* and 8*b*. Locknuts 75*a, b* and *c* are threadably engageable with the bolts 74*a, b* and *c*. Once the desired angle of inclination AI is set, the locknuts 75*a, b* and *c* are tightened into engagement with the outer surface of the roller supports 72*a, b* and *c* to lock the roller supports 72*a, b* and *c* at the selected inclined angle AI. The angle AI is measured relative to a horizontal plane. The structure is such that the angle of inclination AI can be set over a wide range from around 22° to around 40°. As will be seen the rollers 76*a, b* and *c* are of a unique construction to facilitate adjustment of the engagement angle AI over such wide range of from around 22° to around 40°. This is in contrast with existing fillet rolling apparatus where the angle of inclination is either fixed or is only adjustable over a very narrow range.

Thus by simple manipulation of the adjustment pinion gear 109 the radial distance between the rollers 76*a, b* and *c* can be selectively set to secure the effective diameter DR of the work, input opening 48 to accommodate the diameter of the shank 12*a* of the pin blank 10*a* and to define the desired final diameter of the rolled fillet radius R. At the same time, as noted, the angle of the roller supports 72*a, b* and *c* and hence of the rollers 76*a, b* and *c* can be selectively set to provide the desired angle of engagement with the fillet radius Ra for rolling to the finished fillet radius R and to accommodate a large variety of pin blanks.

The roller subassemblies 64*a* and 64*b* are operatively connected to pivot actuators 78*a* and 78*b* which in turn are fixed to the slide stands 68*a* and 68*b*. The pivot actuators 78*a* and 78*b* have pneumatically actuated drive pistons 80*a* and 80*b* having piston rods 81*a* and 81*b* connected to the platforms such as platform 77*a* of roller section 73*a*. The drive pistons 80*a* and 80*b* are separately actuated in response to control signals from the cycle speed and timing assembly 44 of the control and logic board 43 with air pressure being applied at air inlet openings 80*a*' and 80*b*'. The pistons 80*a* and 80*b* are normally actuated by air pressure to maintain the roller subassemblies 64*a* and 64*b* in their closed, original positions and spring actuated upon exhaust of air pressure to pivot the subassemblies 64*a* and 64*b* to their open positions as will be described. Thus when a pin blank 10*a* is to be dropped into the input opening 48 the air pressure on drive piston 80*a* is relieved with the piston rod 81*a* being spring actuated to pivot the roller subassembly 64*a* slightly away from the input opening 48 to facilitate reception of the pin blank 10*a* released from the controlled feed gate 41 and being dropped in from the slide outlet end 51. As this occurs the cycle speed and timing assembly 44 will actuate the air piston assembly 61 whereby the feeder slide 33 will be moved to its advanced position with the outlet end 51 substantially in line with the axis X of the roller input opening 48. The cycle speed and timing assembly 44 will cause the synchronized actuation of the meter fingers 45*a* and 45*b* of the feed gate 41 by the cylinder 63 as previously noted. Now with the pin blank 10*a* located in the input opening 48, enlarged as noted, the cycle speed and timing assembly 44 will provide a signal to close the exhaust from and actuate air pressure to the drive piston 80*a* with the piston rod 81*a* returning the roller subassembly 64*a* and hence the roller 76*a* to the original position placing the input opening 48 in its desired enclosed condition for fillet rolling. The cycle speed and timing assembly 44 will also actuate the piston assembly 61 whereby the feeder slide 33 will be moved to its retracted position in line with the open outlet gate 37 of the pin feeder 35.

These occurrences will actuate proximity sensors 62 and 82*a* which will then provide a signal to the CPU 46 whereby the rolling cycle can continue. If no such signal is received the CPU 46 will be actuated to shut down the system as will be described.

The pivot actuators 78*a* and 78*b* are provided with adjustment knobs 79*a* and 79*b* by which the position of the pistons 80*a* and 80*b* can be varied to vary the stroke of the pistons 80*a* and 80*b* and hence the degree of angular displacement of roller subassemblies 64*a* and 64*b* from the inlet opening 48. This permits adjustment to accommodate pin blanks of different sizes and shapes.

Figure 7C:
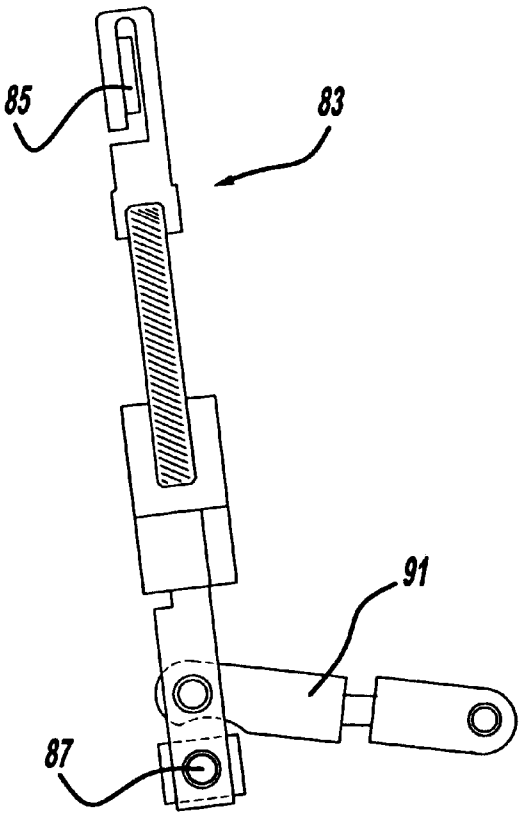
FIG. 7*c* is a top elevational view of a pin removing arm for discharging the pin blank after rolling.

After a preselected time, determined by the cycle speed and timing assembly 44, which is set for the completion of fillet rolling by a procedure to be described, the drive piston 80*b* will be actuated in response to a signal from the control and logic board 43 to relieve air pressure whereby the piston rod 81*b* which is spring biased will be actuated to pivot the roller subassembly 64*b* away from the input opening 48. At the same time a pin removing arm 83 is pivotally mounted on the slide stand 68*b* via a fixed pivot structure 87 and will be pivoted by the roller subassembly 64*b* towards the pin blank 10*a* upon completion of rolling. The arm 83 includes a resilient brush 85 which is adapted to engage the pin blank 10*a* whereby it will be ejected from the enlarged input opening 48 and into the discharge slide 42. See FIG. 7*c*.

The removing arm 83 is pivotally connected to a support member 89 via a link 91. The support member 89 is in turn pivotally supported to the slide stand 68*b*. See FIG. 7. Now when the roller subassembly 64*b* is pivoted away from the opening 48 the support member 89 will be pivoted outwardly whereby the removing arm 83 and link 91 will be actuated to pivot the removing arm 83 around the pivot structure 87 towards the opening 48 with the brush 85 engaging the pin blank 10*a* to eject it. See FIG. 7*b*. In this regard the removing arm 83 is located above the roller subassemblies 64*a* and 64*b*. However, the brush 85 extends downwardly in a substantially clearance position between the rollers 76*a* and 76*b* so as to be able to be pivoted to engage the pin blank 10*a* to move it into the discharge slide 42. After a preselected time, the drive piston 80*b* will be actuated by a signal from the cycle speed and timing assembly 44 with air pressure applied to the piston rod 81*b* to pivot the roller subassembly 64*b* and hence the roller 76*b* back to the original closed position at the input opening 48. This in turn will move the pivotal removing arm 83 with brush 85 back to its original position. Again the movement of the roller subassembly 64*b* to its open position to discharge a pin blank 10*a* after rolling and return back to its closed, original position for rolling another pin blank 10*a* will be sensed by proximity sensor 82*b* which provides signals to the CPU 46 for monitoring the cyclic sequence. Again, if the signals indicative of correct action are not received, the CPU 46 will shut the system down.

Thus in order for the control and logic board 43 to monitor the system the roller subassemblies 64*a* and 64*b* are provided with proximity and position sensors 82*a* and 82*b* and with the feeder slide 33 monitored with the proximity and position sensor 62. These sensors 62, 82*a* and 82*b* are actuated to provide the signals to the CPU 46 of the control and logic board 43 indicating when the roller subassemblies 64*a* and 64*b* and feeder slide 33 are in their advanced positions or in their retracted positions as described. Again, unless the proper cyclic sequence of these events is detected the CPU 46 will be actuated to shut the system down.

Figure 10:
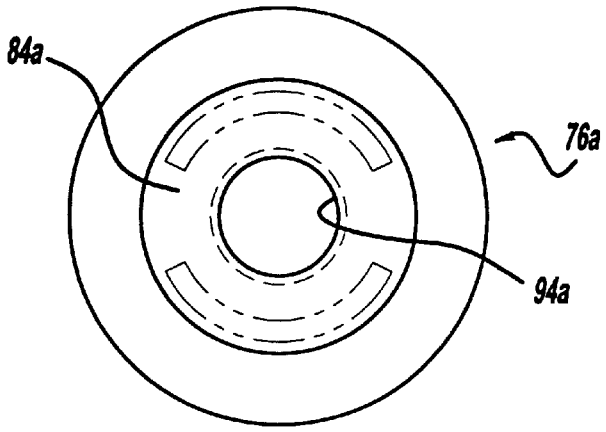
FIG. 10 is a top elevational view of one of the rollers of the roller subassemblies of FIG. 7.
Figure 11:
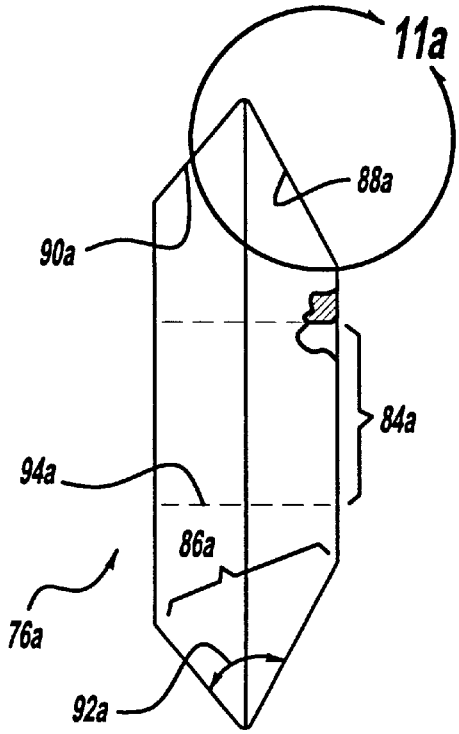
FIG. 11 is an end elevational view of the roller of FIG. 10.
Figure 11A:
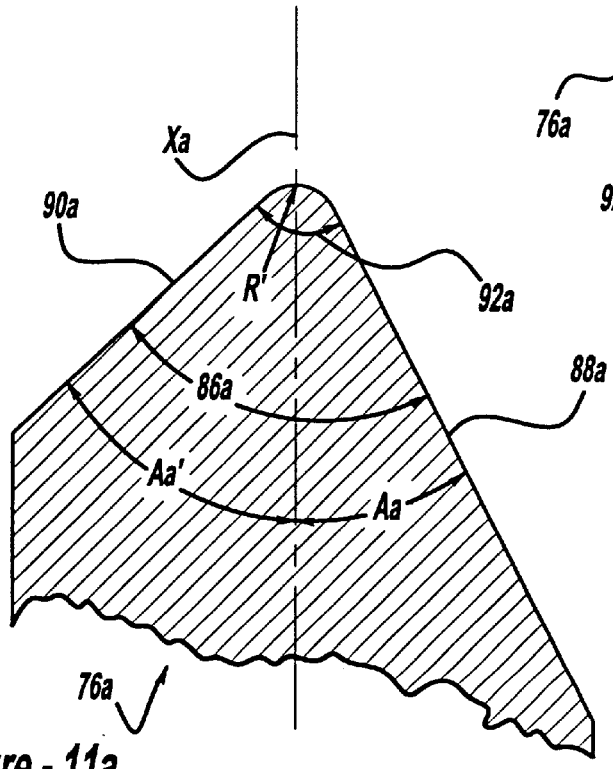
FIG. 11*a* is an enlarged sectional view of a portion of the roller of FIGS. 10 and 11 taken generally in the Circle 11*a* in FIG. 11.

The rollers 76*a, b* and *c* are of a unique construction and one form of these is shown in FIGS. 10, 11 and 11*a*. Since the rollers 76*a, b* and *c* are identical only the details of roller 76*a* are shown and described. The roller 76*a* is of a circular contour and has a generally planar, flat center portion 84*a* which terminates in a generally conical circumferential end section 86*a*. The end section 86*a* has a pair of angulated, planar flanks 88*a* and 90*a* which are connected at their radially outer ends by an arcuate tip 92*a*. The tip 92*a* has a radius R' which is generally the same as the final radius R of the finished pin 10 of FIGS. 1 and 2*a*. Thus, in the rolling operation the tip 92*a* will engage the fillet at the area of radius Ra at the juncture of the pin shank 12*a* and pin head 14*a* of pin blank 10*a* to roll it into the final, uniform radius R in response to the pressure and rotation applied by the push rod 50. The upper flank 88*a* is adapted to be located in spaced confrontation with the underside of the pin head 14*a*. The angle Aa of the flank 88*a* relative to the longitudinal axis Xa of the roller 76*a* is less than the angle Aa' of the lower flank 90*a*. This provides a desired range of clearances with the underside of the pin head 14*a*. This also facilitates use of the rollers 76*a, b* and *c* over the wide range AI of angular adjustments of the roller supports 72*a, b* and *c* to accommodate variations in pin head geometries. In one form of the invention the angle Aa on the upper flank 88*a* was around 27° while the greater angle Aa' on the lower flank 90*a* was around 47°.

The roller 76*a* has a central bore 94*a* by which the roller 76*a* is mounted to freely rotate on a shaft 96*a*. The shaft 96*a* is located by a simple close fit in slots 98*a* in the outer end of the roller support 72*a*. This facilitates ease of assembly and disassembly of rollers 76*a, b* and *c* for replacement for wear, substitution of different rollers for a different fillet radius R and the like. The shaft 96*a* is held from rotation by a set screw having its shank engaged with a flat side of the shaft 96*a*. Thus the roller 76*a* can freely rotate on the shaft 96*a* while the shaft 96*a* is held from rotation. The use of set screws engageable with a flat side of an element to inhibit rotation of the element is old in the art and hence the details thereof have been omitted for simplicity and brevity.

Figure 4A:
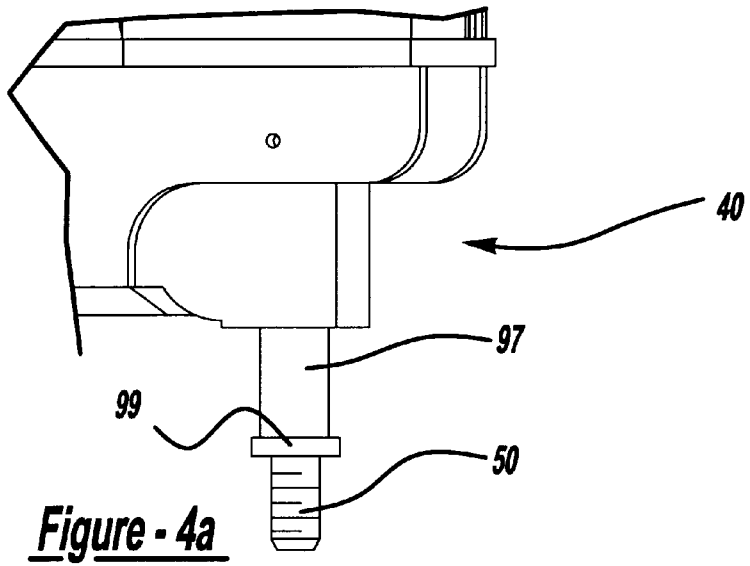
FIG. 4*a* is an enlarged, fragmentary view of a portion of the rotary push rod assembly of FIGS. 3 and 4 taken generally in the area of the Circle 4*a* in FIG. 4.

Let us now look to the rotary push rod assembly 40 as shown in FIGS. 3, 4 and 4*a*. The rotary push rod assembly 40 has its rotary push rod 50 supported for vertical reciprocation towards and away from the work, input opening 48 of the roller assembly 38. The downward movement is effected by pneumatic pressure while the upward return movement is spring actuated as the pressure is relieved. Thus after a pin blank 10*a* has been inserted into the roller input opening 48 and the roller subassembly 64*a* pivoted back to its, closed position, the cycle speed and timing assembly 44 will transmit an actuating signal to the rotary push rod assembly 40 which will then be actuated to move the rotary push rod 50 downwardly into engagement with the pin head 14*a*. At the same time the actuating air pressure on the push rod 50 is preset by the operator relative to the size and form of the pin blank 10*a* to provide the desired magnitude of engagement force. The magnitude of such pressure is observable while the magnitude of the applied force is monitored by the CPU 46 which at the same time is monitoring the speed of the rotary push rod 50. The pin blank 10*a* then is rotated against the rollers 76*a*, 76*b* and 76*c* with the applied force and rate of rotation monitored.

The vertical distance traveled by the push rod 50 for such engagement is preset by the operator for each different size and form of pin blank 10*a*. Here the push rod 50 is threadably secured in a threaded bore in a support shaft 97 which is secured for reciprocation vertically. The push rod 50 is threaded over a significant part of its length. See FIGS. 4 and 4*a*. Thus the distance that the push rod 50 extends past the end of the support shaft 97 can be selectively varied by threading the push rod 50 more or less into the support shaft 97. Now a lock nut 99 is threadably engaged with the push rod 50 and into engagement with the end of the support shaft 97 to lock the pre-set, selected position of the push rod 50 with the support shaft 97. Thus, while the stroke of the support shaft 97 of the push rod assembly 40 can be maintained constant the final vertical position of the push rod 50 relative to the input opening 48 can be selectively varied to accommodate different sized pin blanks 10*a*. The push rod 50 is rotated during the engagement for rolling under a preselected force and at a preselected speed to provide a preselected number of revolutions of the pin blank 10*a* for providing the desired fillet radius R. Upon completion of the fillet rolling for a preselected time as set by the speed and timing assembly 44, the rotary push rod 50 is retracted vertically upwardly to its original disengaged position. At the same time the drive piston 80*b* is actuated by a signal from the cycle speed and timing assembly 44 to pivot the roller subassembly 64*b* with the roller 76*b* being moved to open up the input opening 48. As this occurs, the pin removing arm 83 is actuated, as noted, to pivot the brush 85 against the pin blank 10*a* to move it out of the input opening 48 and into the discharge slide 42. When this occurs the roller subassembly 64*b* is pivoted back to move the roller 76*b* to the original position for closing the input opening 48 with the removing arm 83 returned to its original position whereby the cycle can be repeated with a new pin blank 10*a*.

The rotary push rod assembly 40 is essentially of a known pneumatically actuated drill press construction such as one made by Manhattan Mfg. Co. as Model No. 951205 which is rotated by an electric drive motor. In this regard, the drill press is modified with the push rod 50, the support shaft 97 and lock nut 99 replacing the typical gripper jaws used for gripping the shank of a drill or other type of rotatable tool. At the same time pneumatic pressure is selectively variable for presetting by the operator to provide the desired magnitude of load applied by the push rod 50 to the pin head 14*a* during rolling. Also as noted the speed of rotation of the electric drive motor can be selectively set by the operator through an electric control such as a rheostat.

It should be noted that the operation of the rotary push rod assembly 40 is monitored. Thus looking now to FIGS. 4 and 4*a*, the upper vertical position of the push rod 50 is monitored by a position sensor 100. At the same time the force applied by the push rod 50 onto the pin head 14*a* during rolling is detected by a load sensor 102. In addition the speed of the revolutions of the push rod 50 and hence of the pin blank 10*a* is detected by a rotational speed sensor 104. The magnitude of the applied load as sensed by the load sensor 102 is monitored by the CPU 46. Now if the monitored value of the magnitude of engagement load is within a predetermined range of values as preset for that particular form of pin blank 10*a* then the pin blank 10*a* will be discharged to the slide 42 and funneled to a good part collector or bin. On the other hand, if the desired range of engagement load values is not attained then the CPU 46 will provide a signal to the discharge slide 42 whereby the pin blank 10*a* will be funneled to a rejected part collector or bin. On the other hand, the rotary speed of the push rod 50 is detected by speed sensor 104 and will provide a visual indication to the operator. At the same time the rotational speed detected by sensor 104 will be transmitted to the CPU 46 and unless it is within a preselected range the CPU 46 will be actuated to shut the system down. The emergency shut-off display 144 will also be actuated to alert the operator.

At the same time the position sensor 100 is set to detect the location of the push rod 50 in its uppermost position at the beginning of each cycle. Such signal will also be observable by the operator. However, if the push rod 50 is not in its uppermost position when the cycle starts, the CPU 46 will provide a signal to shut down the apparatus 26 and again will actuate the emergency shut-off display 144 to alert the operator.

It should be noted that the position sensor 100, the load sensor 102 and rotational speed sensor 104 are essentially standard components of known structures. For example the load sensor 102 can be a load cell made and sold by Futek Inc. as a Model No. Micro-P which detects and displays the magnitude of force or load applied by the push rod 50. At the same time the proximity and position detectors 82*a* and 82*b* and position sensor 100 can be conventional devices such as Allen-Bradley sensors 871C-DM1NN7-P3.

Figure 12:
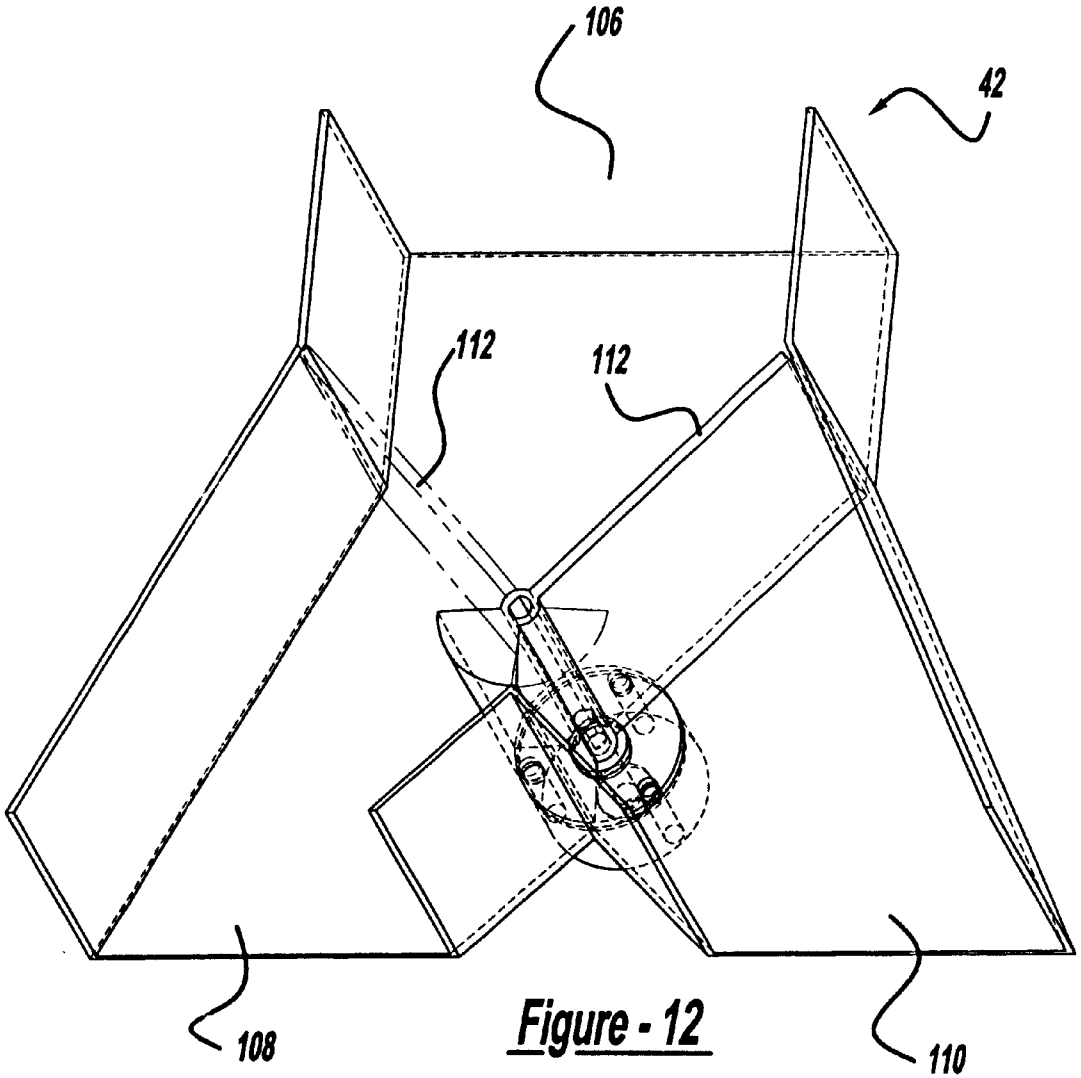
FIG. 12 is a perspective view of a discharge slide of the fillet rolling apparatus of FIGS. 3 and 4 and shown with a gate in a condition for channeling acceptably rolled pin blanks into a good or accepted parts bin and with the gate shown in phantom lines in a condition for channeling unacceptable rolled pin blanks into the bad or rejected parts bin.

Let us now look at the discharge slide 42 as seen in FIGS. 3 and 12. The slide 42 has a forked structure with an entrance channel 106 which leads into a good part channel 108 and a rejected part channel 110. A gate 112 is operatively movable to open one of the channels 108 and 110 while closing the other. As shown in FIG. 12, the gate 112 is in the position with the good part channel 108 open and the rejected part channel 110 closed. In this regard, the gate 112 is normally held in that position. Thus when a pin blank 10*a* has been monitored to be properly fillet rolled it is ejected from the roller input opening 48 into the discharge slide 42 and will move from the entrance channel 106 into the good part channel 108 to be funneled into a good part collector or bin(not shown). However, if the load parameter as monitored by the CPU 46 does not meet its preselected level, the CPU 46 will transmit a reject signal whereby the gate 112 will be moved to close the good part channel 108 and open the rejected part channel 110 whereby the rejected pin blank 10*a* will be funneled to a rejected part collector or bin (not shown) In FIG. 12 the gate 112 is shown in the latter position in phantom lines.

The fillet rolling apparatus 26 will continue to repeat the fillet rolling cycle on a preset cyclic basis. As will be seen the preset cycle is selected by the operator via the speed and timing assembly 44. However, if five consecutive pin blanks 10*a* are rejected, this will be detected by the CPU 46 which will close the system down and provide an alert signal to the operator via the shut-off display 144. In this regard, in the event pin blanks 10*a* with shanks 12*a* of a larger diameter and/or pin heads 14*a* larger than the apparatus 26 is set for are placed in the hopper bowl 31, the inlet 39 will not permit entry into the feeder slide 33 and none of the parameter signals will be received by the CPU 46 within the preset cycle time whereby this will be sensed for five fillet rolling cycles after which the apparatus 26 will be shut down as noted.

On the other hand a smaller pin blank 10*a* with a shank 12*a* of a smaller diameter or a head 14*a* smaller than the mechanical structure 28 of the apparatus 26 is set for may be accepted by the inlet 39 and will then be moved into the roller input opening 48. However, since the pin head 14*a* may be located further into the input opening 48, the magnitude of force applied by the push rod 50 will be reduced accordingly. Thus the engagement of an improper pin blank with the rollers 76*a–c* will be different whereby the engagement force of the push rod 50 will be reduced. These variations in values will be detected and transmitted to the CPU 46 whereby such pin blank 10*a* will be ejected through the rejected channel 110 into the rejected parts bin. Again, upon the detection of five consecutive rejections the CPU 46 will be operative to shut the apparatus 26 down and provide a shut down alert signal to the operator via shut-off display 144. In a similar manner a pin blank 10*a* with a different sized or shaped pin head 14*a* and/or smaller diameter shank will be detected by operational variations as noted above resulting in discharge of such pin blank 10*a* into the rejected parts bin.

Thus the inadvertent inclusion of pin blanks 10*a* in the hopper bowl 31 of the wrong geometry will be detected and such parts will not be accepted or if accepted will be rejected after rolling.

Thus, the CPU 46 will receive signals from the load sensor 102 whereby it can be determined that the proper magnitude of applied load by the push rod 50 has not been attained. Also the load sensor 102 will provide a signal if the load applied by the push rod 50 is the proper magnitude whereby the number of pin blanks 10*a* rolled to the proper parameters can be determined. Such signals are transmitted to a parts counter 142 when the preset magnitude is attained whereby the number of good parts rolled will be counted. In this regard, it can be seen that while the magnitude of pressure applied to the drive mechanism actuating the push rod 50 is displayed, the actual force applied by the push rod 50 to the pin blank 10*a* is measured and is the factor used in determining whether or not the pin blank 10*a* is of the correct type and/or properly rolled. In other words even though the applied pressure may be within a selected range, the actual force applied in rolling may not be.

Figure 15:
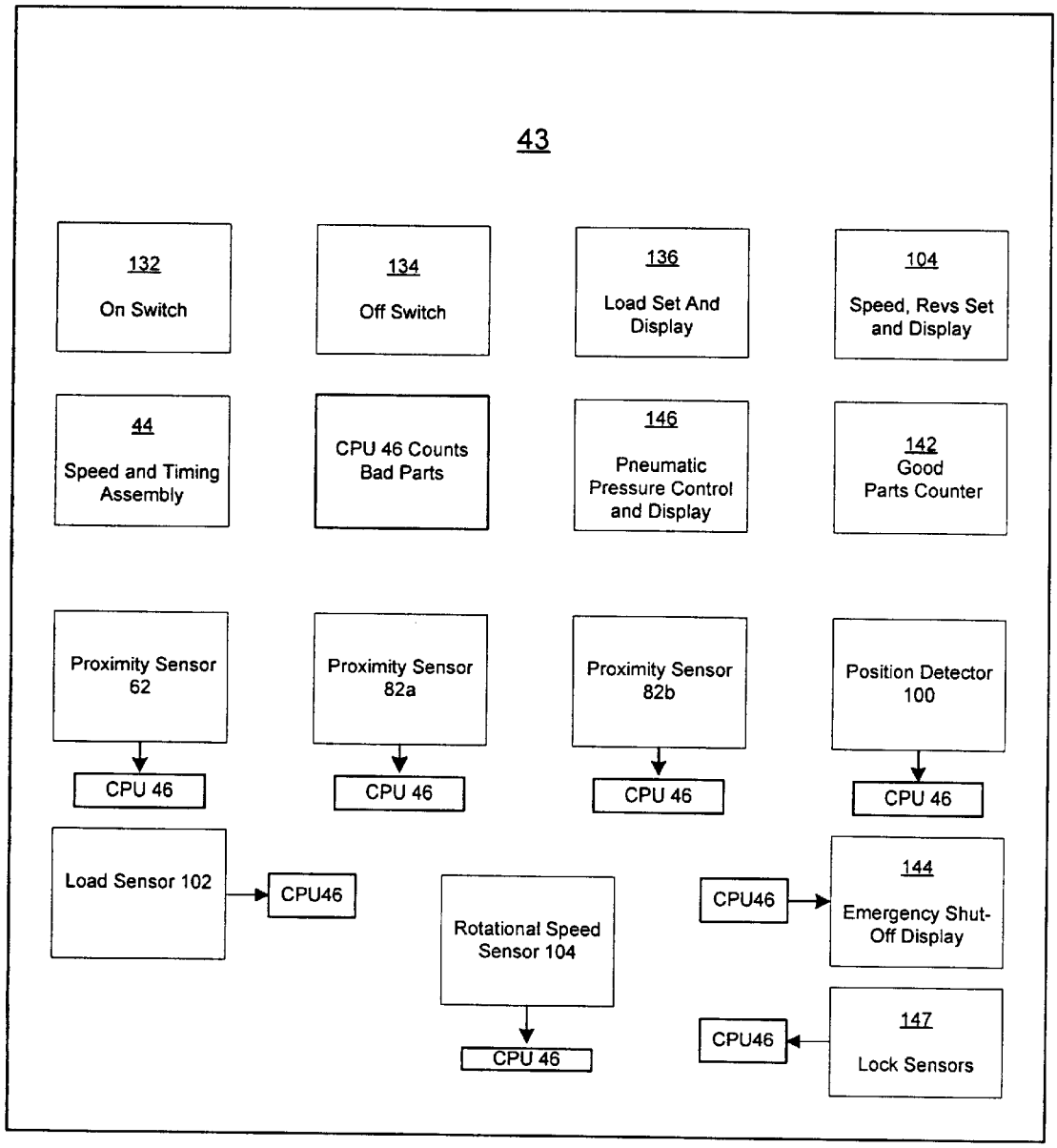
FIG. 15 is block diagram type drawing of elements operational with the control and logic board of FIGS. 3 and 4.

The control and logic board 43 contains the elements for setting various ones of the operative parameters with the CPU 46 then monitoring the actual values attained for controlling certain operations of the apparatus as previously discussed. The basic elements of the CPU 46 of control and logic board 43 are shown in a general block diagram form in FIG. 15.

Thus the CPU 46 has an input which receives the signal from the proximity sensor 62 indicating the position of the feeder slide 33 when it is in the advanced position for feeding a pin blank 10*a* or in the retracted position for actuation of the push rod assembly 40 for rolling. Likewise the CPU 46 has inputs for receiving signals from the proximity sensors 82*a* and 82*b*, respectively, indicating the attainment of the preset advanced and retracted positions for the roller subassemblies 64*a* and 64*b*, respectively, for accepting a new pin blank 10*a*. The CPU 46 will receive other signals to monitor actuation of the push rod assembly 40 for rolling and actuation of the pin removing arm 83 for discharging the rolled pin blank 10*a* from the roller assembly 38.

The CPU 46 has an input for receiving the signal from the position detector 100 indicating the correct position of the rotary push rod 50 at the beginning of each cycle. Also the CPU 46 has an input for receiving the signal from the load sensor 102 indicating the magnitude of force applied by the push rod 50 against the pin head 14*a*. In addition an input receives the signals from the rotational speed sensor 104 indicating the speed of rotation of the rotary push rod 50.

At the same time the logic board 43 has an On Switch 132 and an Off Switch 134 for manually turning the apparatus 26 on or off. In addition the logic board 43 has a load set and display element 136 by which the operator can select and set the pressure to the push rod 50 to attain the desired level of force to be applied by the rotary push rod 50 to the pin head 14*a* in rolling. Such display element 136 can be of a type well known in the art. The load set and display element 136 is a part of the Futek load cell 102 noted above. As noted the rotational speed sensor 104 provides means by which the operator can set and observe the desired speed of rotation of the push rod 50 and whereby the total number of revolutions to be applied by the push rod 50 to the pin head 14*a* in the rolling operation can be set. As noted the logic board 43 also has a parts counter element 142 which provides an indication of the number of rolled pin blanks 10*a* which have been sent to the good parts bin in response to load sensor 102 indicating that rolling has taken place at the desired magnitude of load. In addition there is an emergency shutoff display 144 to provide a visual indication to the operator that the apparatus 26 has been turned off when one of the conditions indicating an improper parameter value for rolling of pin blanks 10*a*, is detected as previously noted. In this regard an audio alarm signal could also be provided to signal shut down. It should be noted that the rotation sensor speed element 104, counter element 142 and shut-off display 144 are devices well known in the art and thus these elements and other conventional elements are shown only in block diagram form.

Since the feeder slide assembly 32, the pivot actuators 78*a* and *b*, and the rotary push rod assembly 40 are all pneumatically operated, it is important that the proper, preselected magnitude of air pressure from a source of pneumatic pressure be present. This magnitude of air pressure is set by the operator by a pneumatic pressure control 146 which also provides a display of the magnitude for the operator. If the magnitude of pneumatic pressure is not at the desired level then the pressure control 146 will provide a visual indication to the operator whereby the apparatus 26 can be adjusted.

Also as previously noted, the mechanical structure 28 of the apparatus 26, generally as shown on support platform 30, is essentially surrounded by sliding or pivotal doors or windows 49 for being selectively opened or closed by the operator. Each of these doors or windows 49 has a lock sensor 147 which senses the open or closed position of each of the doors or windows 49. Each of these sensors is connected to the CPU 46 whereby the apparatus 26 will be prevented from starting if any of the doors or windows 49 is detected to be open. As noted such a feature is well known in the art and thus the details have been omitted for simplicity and brevity. In this regard the lock sensors 147 and air pressure control 146 are of conventional known constructions and since the details thereof do not form a part of the present invention, such details have been omitted for purposes of brevity and simplicity. For example the lock sensors 147 can be of a type such as Honeywell enclosure switch 14CE.

Figure 14:
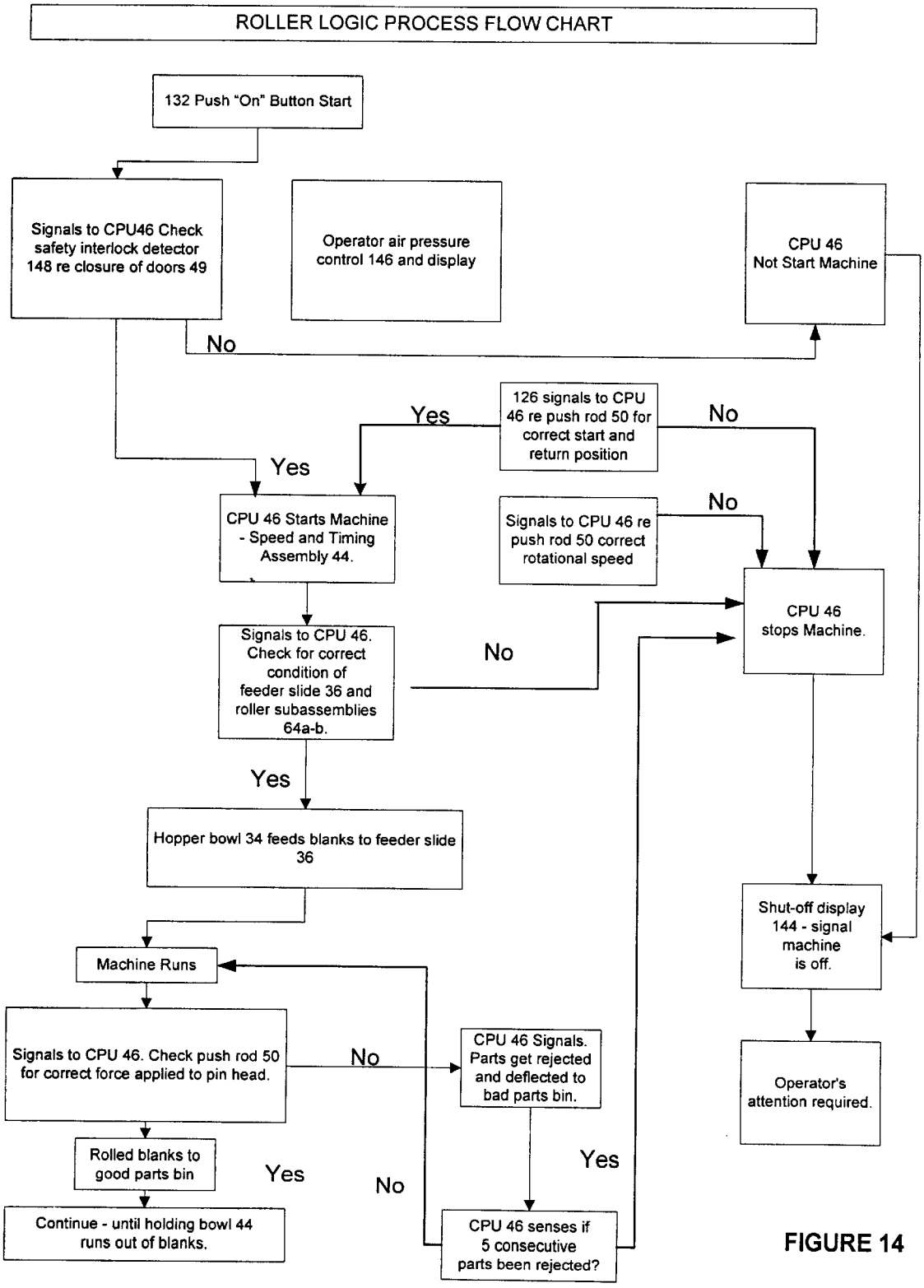
FIG. 14 is a Roller Logic Process Flow Chart illustrating numerous ones of the operative parameters being monitored and controlled.

Signals received and elements preset as noted are communicated to the central processing unit CPU 46, whereby certain parameters of the operation of the rolling apparatus 26 are monitored and controlled as noted. Various ones of the elements monitored and controlled are noted in the Roller Logic Process Flow Chart of FIG. 14 which outlines various ones of the operational sequences discussed above. As noted and previously described, the operational connection between various elements of the control and logic board 43 is generally shown in block diagram form in FIG. 15.

As indicated various elements operative with the control and logic board 43 noted for sensing, monitoring and setting the numerous operative parameters are of structures well known to those skilled in the art and hence these have only been generally described for purposes of simplicity and brevity.

As noted the apparatus 26 is versatile and can be adapted and adjusted for different types and sizes of pin type fasteners having shanks of different diameters, different sizes and styles of pin heads, different materials. This may require variations in the overall cycle time and in the time for performance of the different steps noted. This is provided by the cycle speed and timing assembly 44 which includes a cam subassembly 150 and drive motor 152. See FIGS. 13 and 13*a*.

The cam subassembly 150 has a plurality of cams driven by the electric drive motor 152 with the cams constructed to sequentially actuate and deactuate the various steps in rolling by sequentially providing timing signals to the various components. This is done by the cams of the subassembly 150 being constructed with actuating lobes to provide the signals in a selected sequence with a desired dwell time for each operative step. The overall cycle time will be determined by the rotational speed of the electric drive motor 152 which speed can be set with the cycle speed and timing assembly 44 by the operator for a particular pin structure. For different pin structures, if needed, different cams can be used having the necessary lobed structures for controlling the sequential timing and duration of the various steps for rolling that pin. In addition the overall cycle speed as determined by the rotational drive speed of the electric motor 152 can be selectively set by the operator through a rheostat 153 in the cycle speed and timing assembly 44 or other speed control mechanism. See FIG. 13*a*.

Figure 13:
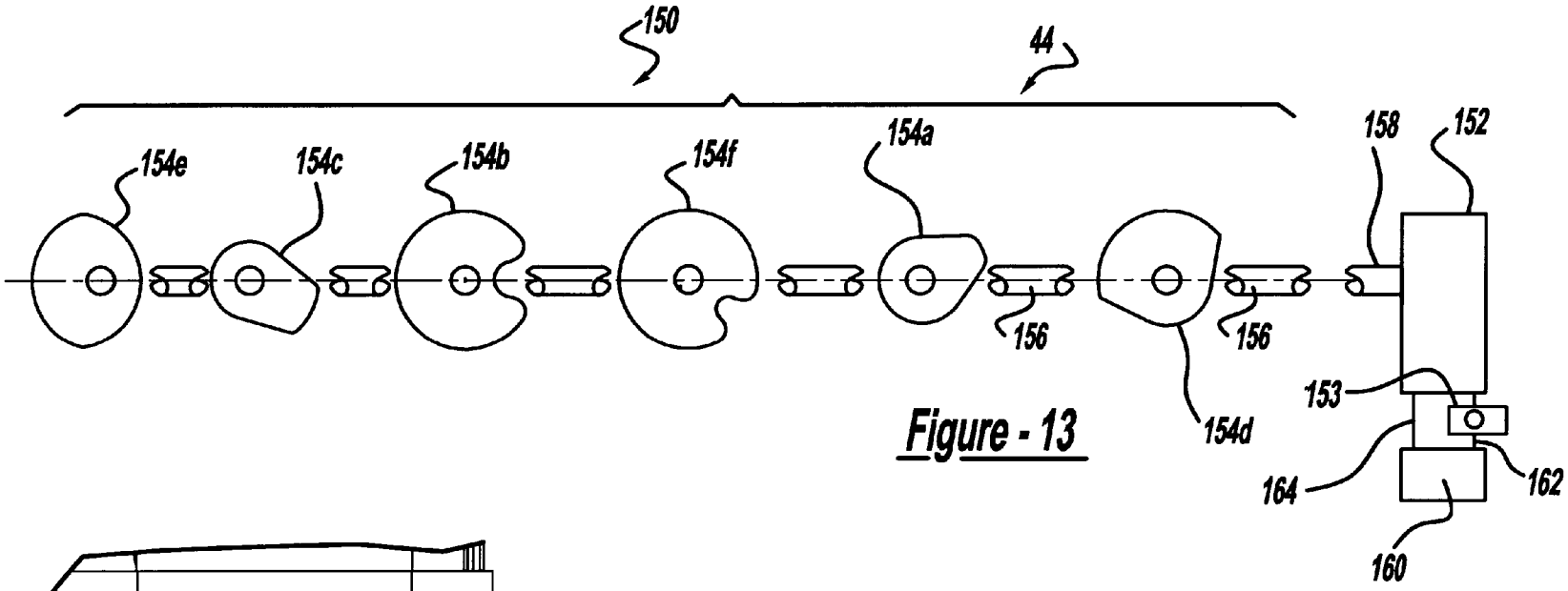
FIG. 13 is an exploded view diagram of a cycle speed and timing assembly, including a cam subassembly, for controlling the sequence of operations for a rolling cycle.

Looking now to FIG. 13 the cam subassembly 150 is generally schematically shown and includes six cams 154*a–f* which are mounted upon a common shaft 156 for rotation together. The common shaft 156 is coupled to a drive shaft 158 of the drive motor 152. The motor 152 is energized by a source of electricity 160 via lines 162 and 164. The rheostat 153 or other control mechanism is in electrical line 162 and is thereby actuable to selectively control the rotational speed of the motor 152 and hence of the cams 154*a–f*.

Figure 13A:
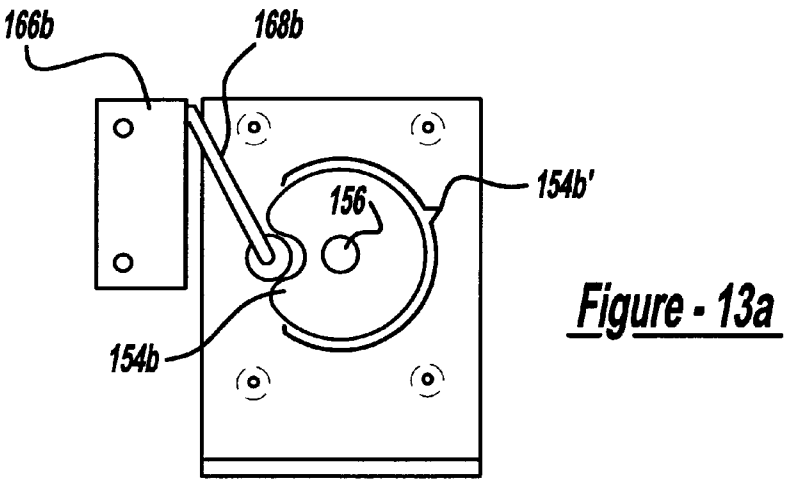
FIG. 13*a* is an elevational view illustrating by way of example one of the cams of FIG. 13 in relationship with a switch and actuating arm for actuating the switch.

The cams 154*a–f* are each operatively connected with an electrical microswitch. An example is shown in FIG. 13*a* where the cam 154*b* is shown operatively connected with a microswitch 166*b* via an actuating pivot arm 168*b*. As shown the switch 166*b* will be actuated when the pivot arm 168*b* is engaged by the lobed surface 154*b*' of the cam 154*b*. In the position shown the arm 168*b* is not so engaged and thus the switch 166*b* is not actuated. It should be noted that the lobed surfaces as shown on the cams 154*a–f* are exemplary only.

In the sequence of operation, the cam 154*b* is operative to cause the roller subassembly 64*a* to pivot away from the input opening 48. The cam 154*a* is operative to move the feeder slide assembly 32 with the outlet end 51 of the feeder slide 33 advancing in line with the inlet opening 48 of the roller assembly 38 whereby the pin blank 10*a* can be dropped into the opening 48. Next the cam 154*c* is operative to actuate the meter fingers 45*a* and 45*b* of the feed gate 41 with the lower, exit meter finger 45*b* moving out of its position blocking the holding area 57 whereby the pin blank 10*a* in that area can be fed down the feeder slide 33 and with the upper, entrance meter finger 45*a* being in its position to block the holding area 57 of the feed gate 41. Next the cam 154*b* is operative to pivot the roller subassembly 64*a* back to its original position at the inlet opening 48. As this occurs the roller 76*a* engages the pin blank 10*a* moving it fully into the inlet opening 48. The cam 154*d* is then operative to actuate the feeder slide assembly 32 with the feeder slide 33 being retracted back to the open outlet gate 37 at the feed bowl 31 and away from the roller input opening 48. As this occurs the cam 154*c* is operative to actuate the lower meter finger 45*b* back into its position blocking the outlet of the holding area 57 and moving the upper meter finger 45*a* to open the inlet of the holding area 57 to receive another pin blank 10*a* from the ones stored in the feeder slide 33. The upper meter finger 45*a* is then actuated to close the holding area 57 to lock the newly received pin blank 10*a* in the holding area. As this is happening, the cam 154*e* is operative to actuate the push rod 50 to descend into engagement with the head 14*a* of the pin blank 10*a* to initiate fillet rolling. Upon completion of a preselected time the cam 154*e* is operative to actuate the push rod 50 to ascend to its original position. Now the cam 154*f* is actuated to cause the roller subassembly 64*b* to pivot away from the input opening 48 and to pivot the pin removing arm 83 to engage the rolled pin blank 10*a* with the brush 85 and move it into the discharge slide 42 for funneling to the proper bin. Now the cam 154*f* is actuated to cause the roller subassembly 64*b* to be moved back to its original closed position and return the pin removing arm 83 to its original deactuated position. The apparatus is now in condition to repeat the cycle. It should be noted that a number of the actuations can overlap whereby the time for process can be expedited.

Again, as noted, the CPU 46 can be readily programmed to monitor the necessary control signals which are pre-set to accommodate variations in the pin blank 10*a* to be rolled.

It should be noted that while the pin blank, such as pin blank 10*a*, being rolled is referred to as a "pin blank" it can have, pull grooves, threads, etc. preformed before the rolling step. In other words the method and apparatus of the present invention can be utilized on a headed pin type article whenever it is applicable or desirable in the manufacturing process of such article. In this regard, it should be noted that components of other constructions could be utilized to perform certain of the functions for the apparatus 26.

It should also be noted that other variations could be provided to the fillet rolling apparatus 26. For example, it may be desirable in some instances to provide more or less than three roller subassemblies such as subassemblies 64*a–c*. Also in some instances it might be desirable to have more than one of the roller subassemblies 64*a–c* to be selectively movable for insertion of a pin blank 10*a* into the input opening 48 and/or for discharging the pin blank 10*a* upon completion of rolling.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. In a pin type structure having an elongated pin shank with an enlarged pin head at one end, apparatus for rolling a fillet radius at the juncture of the pin head and pin shank, said apparatus comprising:

a roller assembly, a pin feeder, and a push rod assembly, said roller assembly including a plurality of roller subassemblies, each of said roller subassemblies including a rotatably supported roller, said roller having a generally circular contour and terminating at its radially outer end in a circumferential arcuate tip having a contour for forming the fillet radius, said roller subassemblies adapted to be mounted with said rollers oriented to define an input opening having a vertical axis for receiving the pin shank with said rollers engaging the juncture at the pin head and pin shank, said pin feeder operatively associated with said roller assembly and having an outlet end locatable substantially in line with said vertical axis of said input opening to periodically have a pin drop substantially vertically into said input opening, said push rod assembly operatively associated with said roller assembly and including a push rod adapted to be moved vertically into engagement with the pin head when located in said input opening, said push rod being rotatable and adapted to engage the pin head at a preselected magnitude of force against said arcuate tips of said rollers and to rotate the pin at a preselected speed of rotation whereby the fillet radius is roll formed by said arcuate tips at the juncture of the pin head and pin shank.

2. The apparatus of claim 1 with said push rod assembly including load means for selectively setting the desired magnitude of rolling force applied by said push rod against the head of the pin in roll forming the fillet.

3. The apparatus of claim 1 with said push rod assembly including distance means for selectively setting the desired travel distance of vertical travel of said push rod to engage the pin head.

4. The apparatus of claim 1 with said apparatus including speed and timing means for controlling various operations for rolling and including rotation means for selectively setting the speed of rotation of said push rod while engaged with the pin head.

5. The apparatus of claim 1 with said apparatus including speed and timing means for controlling various operations for rolling and including revolution means for selectively setting the number of revolutions of the pin during engagement of said push rod with the pin head.

6. The apparatus of claim 1 with said apparatus including speed and timing means for controlling various operations for rolling and including rotation means for selectively setting the speed of rotation of said push rod while engaged with the pin head, and further including revolution means for selectively setting the number of revolutions of the pin during engagement of said push rod with the pin head.

7. The apparatus of claim 1 with said push rod assembly including load means for selectively setting the desired magnitude of rolling force applied by said push rod against the head of the pin in roll forming the fillet, said push rod assembly including load detection means for measuring the magnitude of the rolling force applied by said push rod against the head of the pin in roll forming the fillet and in providing a reject signal whereby a pin on which the measured rolling force is outside of a preselected range of the rolling force will be rejected.

8. The apparatus of claim 1 with said push rod assembly including distance means for selectively setting the desired magnitude of vertical travel of said push rod to engage the pin head, said push rod assembly including travel detection means for measuring the magnitude of the actual vertical travel of said push rod to engage the pin head and for providing a reject signal whereby a pin in which the measured travel distance is outside of a preselected range will be rejected.

9. The apparatus of claim 1 with said push rod assembly including load means for selectively setting the desired magnitude of rolling force applied by said push rod against the head of the pin in roll forming the fillet, said push rod assembly including distance means for selectively setting the desired travel distance of vertical travel of said push rod to engage the pin head.

10. The apparatus of claim 1 with said push rod assembly including load means for selectively setting the desired magnitude of rolling force applied by said push rod against the head of the pin in roll forming the fillet, said push rod assembly including load detection means for measuring the magnitude of the rolling force applied by said push rod against the head of the pin in roll forming the fillet and in providing a reject signal whereby a pin on which the measured rolling force is outside of a preselected range will be rejected, said push rod assembly including distance means for selectively setting the desired travel distance of vertical travel of said push rod to engage the pin head, said push rod assembly including travel detection means for measuring the magnitude of the actual vertical travel of said push rod to engage the pin head and for providing a reject signal whereby a pin in which the measured travel distance is outside of a preselected range will be rejected.

11. The apparatus of claim 9 further comprising:

monitoring means for tracking the number of rejected pins and for disabling the apparatus in the event a preselected number of rejected pins is detected.

12. The apparatus of claim 9 further comprising:

an outlet slide assembly having an entrance channel for receiving pins from said roller assembly upon completion of the rolling, said outlet slide assembly having a good part channel and a rejected part channel connected to said entrance channel, a gate means operatively connected with said good part channel and said rejected part channel to permit only one to be in communication with said entrance channel, said gate means normally connecting said good part channel to said entrance channel for transmitting pins rolled within the selected, preset parameters to a good part collector, said gate means being operative in response to a signal indicating the rolling of a pin not meeting any one of the set parameters to block said good part channel from said entrance channel while opening said rejected part channel whereby the rejected pins will be transmitted to a rejected parts collector.

13. The apparatus of claim 1 with at least one of said roller subassemblies being selectively movable between a position away from said input opening to enlarge said input opening to facilitate insertion of a pin into said input opening and to return to its original position at said input opening after the pin has been inserted in preparation for rolling.

14. The apparatus of claim 13 including sensing means for sensing the position of said one of said roller subassemblies and actuable to provide a signal to deactuate said apparatus in the event said one of said roller subassemblies is in an incorrect position during the rolling cycle.

15. The apparatus of claim 1 with at least one of said roller subassemblies being selectively movable between a position at said input opening during rolling to a position away from said input opening after rolling to facilitate discharge of the rolled pin.

16. The apparatus of claim 15 including sensing means for sensing the position of said one of said roller subassemblies and actuable to provide a signal to deactuate said apparatus in the event said one of said roller subassemblies is in an incorrect position during the rolling cycle.

17. The apparatus of claim 1 with said pin feeder including a slide inclined downwardly towards said roller assembly for permitting pins to be rolled to freely slide down the slide to said outlet whereby they will be vertically dropped by gravity into said input opening, said pin feeder being selectively movable between a position at which said slide outlet is substantially in vertical alignment with said input opening for inserting the pin into said input opening and to a position removed from said input opening with said slide outlet being out of vertical alignment with said input opening whereby said push rod can be moved vertically into engagement with the pin head of the pin in said input opening in clearance relationship with said slide outlet.

18. The apparatus of claim 17 with at least one of said roller subassemblies being selectively movable between a position away from said input opening to enlarge said input opening to facilitate insertion of a pin into said input opening from slide and to return to its original position at said input opening after the pin has been inserted in preparation for rolling and with at least one of said roller subassemblies being selectively movable between a position at said input opening during rolling to a position away from said input opening after rolling to facilitate discharge of the rolled pin.

19. The apparatus of claim 18 including first sensing means for sensing the position of each one of said roller subassemblies to provide a signal to deactuate said apparatus in the event either of said one of said subassemblies is in an incorrect position during the rolling cycle and including second sensing means for sensing the position of said pin feeder to provide a signal to deactuate said apparatus in the event said pin feeder is in an incorrect position during the rolling cycle.

20. The apparatus of claim 1 with certain of the components being operable by pneumatic pressure from a pneumatic pressure source and further including pressure sensing means for detecting the magnitude of pressure from said pressure source and for providing a signal when the magnitude of pressure from said pressure source is outside of a preselected range whereby said apparatus will be precluded from operating.

21. The apparatus of claim 1 with said roller assembly including at least three roller subassemblies, adjustable support means for holding said roller subassemblies in a preselected orientation relative to each other to provide said arcuate tips at said outlet with a predetermined diameter for rolling the fillet radius on a pin shank of a predetermined diameter, said support means having adjustment means operatively connected with said roller subassemblies whereby said roller subassemblies can be moved simultaneously in unison to vary the magnitude of the preselected diameter for rolling the fillet radius on pin shanks of different diameters.

22. The apparatus of claim 1 with each of said rollers of said roller subassemblies including adjustment means pivotally supporting each said roller for selective adjustment of the angle of the longitudinal plane of each of said rollers relative to a plane transverse to the axis of said opening, said adjustment means providing adjustment of said angle over a range of from around 22° to around 40°.

23. The apparatus of claim 1 with each of said rollers of said roller subassemblies including adjustment means pivotally supporting each said roller for selective adjustment of the angle of the longitudinal plane of each of said rollers relative to a plane transverse to the axis of said opening, said adjustment means providing adjustment of said angle over a range of from around 22° to around 40°, each of said rollers having upper and lower flanks extending angularly from each side of said tip, each of said flanks being angulated at a preselected angle relative to said longitudinal plane of said roller, said upper flank adapted to be in confrontation with the lower, inner surface of the pin head during rolling, said upper flank extending at an angle relative to said longitudinal plane of said roller substantially less than the angle of said lower flank whereby greater clearance is provided between said tip and said roller and the lower, inner surface of the pin head, said upper flank angle being around 27° and said lower flank angle being around 47°.

24. In a pin type structure having an elongated pin shank with an enlarged pin head at one end, apparatus for rolling a fillet radius at the juncture of the pin head and pin shank, said apparatus comprising:

a roller assembly, a pin feeder, and a push rod assembly, said roller assembly including a plurality of roller subassemblies, each of said roller subassemblies including a rotatably supported roller, said roller having a generally circular contour and terminating at its radially outer end in a circumferential arcuate tip having a contour for forming the fillet radius, said roller subassemblies adapted to be mounted with said rollers oriented to define an input opening having a central axis for receiving the pin shank with said rollers engaging the juncture at the pin head and pin shank, said pin feeder operatively associated with said roller assembly and having an outlet end locatable substantially in line with said central axis of said input opening to periodically have a pin moved into said input opening, said push rod assembly operatively associated with said roller assembly and including a push rod adapted to be moved along said central axis into engagement with the pin head when located in said input opening, said push rod being rotatable and adapted to engage the pin head at a preselected magnitude of force against said arcuate tips of said rollers and to rotate the pin at a preselected speed of rotation whereby the fillet radius is roll formed by said arcuate tips at the juncture of the pin head and pin shank, said push rod assembly including load means for selectively setting the desired magnitude of rolling force applied by said push rod against the head of the pin in roll forming the fillet, said push rod assembly including load detection means for measuring the magnitude of the rolling force applied by said push rod against the head of the pin in roll forming the fillet and in providing a reject signal whereby a pin on which the measured rolling force is outside of a preselected range of the rolling force will be rejected.

25. The apparatus of claim 24 with said push rod assembly including distance means for selectively setting the desired travel distance of said push rod to engage the pin head.

26. The apparatus of claim 24 with said apparatus including speed and timing means for controlling various operations for rolling and including rotation means for selectively setting the speed of rotation of said push rod while engaged with the pin head.

27. The apparatus of claim 24 with said apparatus including speed and timing means for controlling various operations for rolling and including revolution means for selectively setting the number of revolutions of the pin during engagement of said push rod with the pin head.

28. The apparatus of claim 24 with said pin feeder including diameter means selectively settable to accept a pin with a pin shank of a predetermined diameter while rejecting a pin with a pin shank of a larger diameter.

29. The apparatus of claim 24 with said push rod assembly including distance means for selectively setting the desired magnitude of travel of said push rod to engage the pin head, said push rod assembly including travel detection means for measuring the magnitude of the actual travel of said push rod to engage the pin head and for providing a reject signal whereby a pin in which the measured travel distance is outside of a preselected range will be rejected.

30. The apparatus of claim 29 further comprising:

monitoring means for tracking the number of rejected pins and for disabling the apparatus in the event a preselected number of rejected pins is detected.

31. The apparatus of claim 29 further comprising:

an outlet slide assembly having an entrance channel for receiving pins from said roller assembly upon completion of the rolling, said outlet slide assembly having a good part channel and a rejected part channel connected to said entrance channel, a gate means operatively connected with said good part channel and said rejected part channel to permit only one to be in communication with said entrance channel, said gate means normally connecting said good part channel to said entrance channel for transmitting pins rolled within the selected, preset parameters to a good part collector, said gate means being operative in response to a signal indicating the rolling of a pin not meeting any one of the set parameters to block said good part channel from said entrance channel while opening said rejected part channel whereby the rejected pins will be transmitted to a rejected parts collector.

32. The apparatus of claim 24 with at least one of said roller subassemblies being selectively movable between a position away from said input opening to enlarge said input opening to facilitate insertion of a pin into said input opening and to return to its original position at said input opening after the pin has been inserted in preparation for rolling.

33. The apparatus of claim 32 including sensing means for sensing the position of said one of said roller subassemblies and actuable to provide a signal to deactuate said apparatus in the event said one of said roller subassemblies is in an incorrect position during the rolling cycle.

34. The apparatus of claim 22 with at least one of said roller subassemblies being selectively movable between a position at said input opening during rolling to a position away from said input opening after rolling to facilitate discharge of the rolled pin.

35. The apparatus of claim 34 including sensing means for sensing the position of said one of said roller subassemblies and actuable to provide a signal to deactuate said apparatus in the event said one of said roller subassemblies is in an incorrect position during the rolling cycle.

36. The apparatus of claim 24 with at least one of said roller subassemblies being selectively movable between a position away from said input opening to enlarge said input opening to facilitate insertion of a pin into said input opening and to return to its original position at said input opening after the pin has been inserted in preparation for rolling and with at least one of said roller subassemblies being selectively movable between a position at said input opening during rolling to a position away from said input opening after rolling to facilitate discharge of the rolled pin.

37. The apparatus of claim 36 including sensing means for sensing the position of each one of said roller subassemblies to provide a signal to deactuate said apparatus in the event either of said one of said subassemblies is in an incorrect position during the rolling cycle.

38. The apparatus of claim 24 with certain of the components being operable by pneumatic pressure from a pneumatic pressure source and further including pressure sensing means for detecting the magnitude of pressure from said pressure source and for providing a signal when the magnitude of pressure from said pressure source is outside of a preselected range whereby said apparatus will be precluded from operating.

39. The apparatus of claim 24 with said roller assembly including at least three roller subassemblies, adjustable support means for holding said roller subassemblies in a preselected orientation relative to each other to provide said arcuate tips at said outlet with a predetermined diameter for rolling the fillet radius on a pin shank of a predetermined diameter, said support means having adjustment means operatively connected with said roller subassemblies whereby said roller subassemblies can be moved in unison to vary the magnitude of the preselected diameter for rolling the fillet radius on pin shanks of different diameters.

40. The apparatus of claim 24 with each of said rollers of said roller subassemblies including adjustment means pivotally supporting each said roller for selective adjustment of the angle of the longitudinal plane of each of said rollers relative to a plane transverse to the axis of said opening, said adjustment means providing adjustment means providing adjustment of said angle over a range of from around 22° to around 40°.

41. The apparatus of claim 24 with each of said rollers of said roller subassemblies including adjustment means pivotally supporting each said roller for selective adjustment of the angle of the longitudinal plane of each of said rollers relative to a plane transverse to the axis of said opening, said adjustment means providing adjustment means providing adjustment of said angle over a range of from around 22° to around 40°, said rollers having upper and lower flanks extending angularly from each side of said tip, each of said flanks being angulated at a preselected angle relative to said longitudinal plane of said roller, said upper flank adapted to be in confrontation with the lower, inner surface of said pin head during rolling, said upper flank extending at an angle relative to said longitudinal plane of said roller substantially less than the angle of said lower flanks whereby greater clearance is provided between said tip and said roller and said lower, inner surface of said pin head, said upper flank angle being around 27° and said lower flank angle being around 47°.

42. In a pin type structure having an elongated pin shank with an enlarged pin head at one end and having a final fillet radius of a preselected contour at the juncture of the pin head and pin shank, said pin structure with said final fillet radius being produced by the process including the steps of:

forming a pin blank having an enlarged pin shank with an enlarged pin head at one end and an initial fillet radius at the juncture of the pin shank and pin head of the pin blank, said process comprising the steps of providing rolling apparatus including:

a roller assembly, and a push rod assembly, providing said roller assembly to have a plurality of roller subassemblies with each of said roller subassemblies including a rotatably supported roller, each of said rollers having a generally circular contour and terminating at its radially outer end in a circumferential arcuate tip having a contour for forming said final fillet radius by engagement with said initial fillet radius, locating said roller subassemblies with said rollers oriented to define an input opening having central axis for receiving the pin shank with said rollers engaging said initial fillet radius at the juncture of the pin head and pin shank, providing said push rod assembly with a rotatable push rod adapted to be moved along said central axis into engagement with the pin head when said pin blank is located in said input opening, actuating said push rod to engage the pin head at a preselected magnitude of force against said arcuate tips of said rollers as engaged with said initial fillet radius and to rotate said pin blank at a preselected speed of rotation whereby said final fillet radius is roll formed by said arcuate tips at the juncture of said pin head and said pin shank, measuring the magnitude of the rolling force applied by said push rod against the head of the pin for roll forming the final fillet radius and in providing a reject signal where a pin blank on which the measured rolling force is outside of a preselected range of the rolling force.

43. The process of claim 42 further including the steps of selectively setting the desired magnitude of travel of said push rod to engage the pin head, measuring the magnitude of the actual travel of said push rod to engage the pin head and for providing a reject signal where the measured travel distance is outside of a preselected range.

44. In a pin type structure having an elongated pin shank with an enlarged pin head at one end, apparatus for rolling a fillet radius at the juncture of the pin head and pin shank, said apparatus comprising:

a roller assembly, said roller assembly including at least three roller subassemblies, each of said roller subassemblies including a rotatably supported roller, said roller having a generally circular contour and terminating at its radially outer end in a circumferential arcuate tip having a contour for forming the fillet radius, said roller subassemblies adapted to be mounted with said rollers oriented to define an input opening having a vertical axis for receiving the pin shank with said rollers engaging the juncture at the pin head and pin shank, adjustable support means for holding said roller subassemblies in a preselected orientation relative to each other to provide said arcuate tips at said outlet with a predetermined diameter for rolling the fillet radius on a pin shank of a predetermined diameter, said support means having adjustment means operatively connected with said roller subassemblies whereby said roller subassemblies can be simultaneously moved in unison to vary the magnitude of the preselected diameter for rolling the fillet radius on pin shanks of different diameters.

45. In a pin type structure having an elongated pin shank with an enlarged pin head at one end, apparatus for rolling a fillet radius at the juncture of the pin head and pin shank said apparatus comprising:

a roller assembly, said roller assembly including at least three roller subassemblies, each of said roller subassemblies including a rotatably supported roller, said roller having a generally circular contour and terminating at its radially outer end in a circumferential arcuate tip having a contour for forming the fillet radius, said roller subassemblies adapted to be mounted with said rollers oriented to define an input opening having a central axis for receiving the pin shank with said roller engaging the juncture at the pin head and pin shank, adjustable support means for holding said roller subassemblies in a preselected orientation relative to each other to provide said arcuate tips at said outlet with a predetermined diameter for rolling the fillet radius on a pin shank of a predetermined diameter, said support means having adjustment means operatively connected with said roller subassemblies whereby said roller subassemblies can be simultaneously moved in unison to vary the magnitude of the preselected diameter for rolling the fillet radius on pin shanks of different diameters.

46. In a pin type structure having an elongated pin shank with an enlarged pin head at one end, apparatus for rolling a fillet radius at the juncture of the pin head and pin shank, said apparatus comprising:

a roller assembly, said roller assembly including a plurality of roller subassemblies, each of said roller subassemblies including a rotatably supported roller, said roller having a generally circular contour and terminating at its radially outer end in circumferential arcuate tip having a contour for forming the fillet radius, said roller subassemblies adapted to be mounted with said rollers oriented to define an input opening having a vertical axis for receiving the pin shank with said rollers engaging the juncture at the pin head and pin shank, each of said rollers of said roller subassemblies including adjustment means pivotally supporting each said roller for selective adjustment of the angle of the longitudinal plane of each of said rollers relative to a plane transverse to the axis of said opening, said adjustment means providing adjustment of said angle over a range of from around 22° to around 40°.

47. The apparatus of claim 46 with each of said rollers having upper and lower flanks extending angularly from each side of said tip, each of said flanks being angulated at an angle relative to said longitudinal plane of said roller, said upper flank adapted to be in confrontation with the lower, inner surface of said pin head during rolling, said upper flank extending at an angle relative to said longitudinal plane of said roller substantially less than the angle of said lower flanks whereby greater clearance is provided between said tip and said roller and said lower, inner surface of said pin head, said upper flank angle being around 27° and said lower flank angle being around 47°.

* * * * *